US008239970B2

(12) United States Patent
Ikeda

(10) Patent No.: US 8,239,970 B2
(45) Date of Patent: Aug. 14, 2012

(54) HELMET WITH A PAD QUICK RELEASE APPARATUS

(75) Inventor: Yoshiyuki Ikeda, Ryugasaki (JP)

(73) Assignee: Shoei Co., Ltd. (JP)

( * ) Notice: Subject to any disclaimer, the term of this patent is extended or adjusted under 35 U.S.C. 154(b) by 288 days.

(21) Appl. No.: 12/491,564

(22) Filed: Jun. 25, 2009

(65) Prior Publication Data

US 2010/0095437 A1 Apr. 22, 2010

(30) Foreign Application Priority Data

Oct. 22, 2008 (JP) ..... 2008-271980

(51) Int. Cl.
*A42B 3/00* (2006.01)

(52) U.S. Cl. ..... 2/414; 2/267; 24/114.4; 24/114.05

(58) Field of Classification Search ..... 2/410–417, 2/420–425, 427, 6.1, 6.6; 24/114.4, 114.5, 24/107, 108, 662, 114.05
See application file for complete search history.

(56) References Cited

U.S. PATENT DOCUMENTS 4,916,759 A * 4/1990 Arai ..... 2/414
6,256,797 B1 * 7/2001 Nemoto et al. ..... 2/414
6,353,978 B1 * 3/2002 Kawahara et al. ..... 24/114.4
6,421,841 B2 * 7/2002 Ikeda ..... 2/414
7,207,071 B2 * 4/2007 Pierce ..... 2/410
2005/0034223 A1 * 2/2005 Durocher ..... 2/425
2006/0064799 A1 * 3/2006 Dion ..... 2/424
2007/0271688 A1 * 11/2007 Ando ..... 2/410
2009/0038054 A1 2/2009 Ikeda

* cited by examiner

*Primary Examiner* — Danny Worrell
*Assistant Examiner* — Khaled Annis
(74) *Attorney, Agent, or Firm* — Jones Day

(57) ABSTRACT

In a helmet according to this invention, a recess-projection fitting mechanism to attach a blockish inside pad on a head protecting cap portion side includes a male hook or female hook on the blockish inside pad side, and a female hook or male hook on the head protecting cap portion. When pulling the inside pad outward from inside the head protecting cap portion at least partly, a recess-projection fitting disengaging slant surface causes one hook to relatively levitate from the other hook, thus relatively disengaging the male hook from the female hook. This invention can provide the helmet which, when worn by a head of a helmet wearer, can be removed with a comparatively small force, and the detaching operation of which can be performed easily and reliably with a comparatively simple arrangement.

19 Claims, 15 Drawing Sheets

HELMET WITH A PAD QUICK RELEASE APPARATUS

TECHNICAL FIELD

The present invention relates to a helmet comprising a head protecting cap portion with one or a plurality of blockish inside pads disposed therein, the at least one blockish inside pad being attached to the head protecting cap portion by one or a plurality of recess-projection fitting mechanisms, the at least one recess-projection fitting mechanism including one hook of a male hook and a female hook which are disposed on the at least one blockish inside pad side, and the other hook disposed on the head protecting cap portion side to be engageable with the one hook by recess-projection engagement, and by pulling the at least one blockish inside pad outward from inside the head protecting cap portion at least partly, the one hook being released relatively from the other hook, thus disengaging the one hook from the other hook, so that the at least one blockish inside pad is pulled outward from inside the head protecting cap portion at least partly. The present invention also relates to a method of removing, from a head of a helmet wearer, a helmet comprising a head protecting cap portion with one or a plurality of blockish inside pads disposed therein, comprising attaching the at least one blockish inside pad to the head protecting cap portion in advance by one or a plurality of recess-projection fitting mechanisms, when attaching the at least one blockish inside pad, using the at least one recess-projection fitting mechanism including one hook of a male hook and a female hook which are disposed on the at least one blockish inside pad side, and the other hook disposed on the head protecting cap portion side to be engageable with the one hook by recess-projection engagement, when removing the helmet worn on the head of the helmet wearer, first, pulling the at least one blockish inside pad outward from inside the head protecting cap portion to release the one hook relatively from the other hook, thus disengaging the one hook from the other hook, and pulling the at least one blockish inside pad outward from inside the head protecting cap portion at least partly, and removing the head protecting cap portion from the head of the helmet wearer.

BACKGROUND OF THE INVENTION

A full-face-type helmet has been well known. This helmet includes a full-face-type head protecting cap portion worn by the rider of a motor cycle or the like on his head to protect the head, a shield plate capable of opening/closing a window opening formed in the front surface of the head protecting cap portion to oppose the portion between the forehead and chin of the helmet wearer, and chin straps attached to the head protecting cap portion. According to such a full-face-type helmet, the substantially entire head of the helmet wearer can be protected by the head protecting cap portion.

The conventional full-face-type helmet having the above structure, however, is not easy to wear on and remove from the head of the wearer because the head protecting cap portion is naturally also of a full-face type. According to recent full-face-type helmets, to improve the stability of the helmets and feeling of wearing them during a drive, the lower end portion of the head protecting cap portion is narrowed. In addition, it fits the head and face of the wearer more tightly due to blockish inside pads for the cheeks and the like. Owing to this structure, when a helmet wearer, e.g., the rider of a motor cycle, has a traffic accident, e.g., a motor cycle accident, a person who takes care of the rider needs a large force to remove the full-face-type head protecting cap portion from the head of the helmet wearer. For this reason, it is considerably difficult for one person to remove the helmet from the wearer.

This will be described below with reference to FIG. 16. FIG. 16 shows an experiment aimed at measuring the force required to remove a full-face-type helmet 1. A bolt 4 with a ring is attached to the top portion of a full-face-type head protecting cap portion 3 of the conventional full-face-type helmet 1 worn on the head of a helmet wearer 2. The lower end of a spring balancer 5 is coupled to the bolt 4.

In the state shown in FIG. 16 (the chin straps (not shown) were unfastened from the chin of the helmet wearer 2), the upper end of the spring balancer 5 was pulled upward. In this case, when a pair of blockish inside pads for the right and left cheeks were attached to the interior of the head protecting cap portion 3, the helmet 1 could not be removed until a tension of 16 kg was applied to the top portion of the head protecting cap portion 3. In contrast to this, when the pair of blockish inside pads for the right and left cheeks were detached from the interior of the head protecting cap portion 3, the helmet 1 could be removed by applying only a tension of 2.5 kg to the top portion of the head protecting cap portion 3.

The experiment shown in FIG. 16 revealed that a large force was usually required to remove the full-face-type helmet 1, and that not so large force was required to remove the full-face-type helmet 1 when the blockish inside pads for the cheeks were detached from the interior of the head protecting cap portion 3.

On the basis of the results of the experiment shown in FIG. 16, the present applicant previously proposed the invention disclosed in U.S. Pre-grant Publication No. 2007/271688 Al (to be referred to as "the prior patent reference" hereinafter). According to the invention disclosed in the prior patent reference, when the rider of the motor cycle or the like wears the above-described full-face-type helmet, in order to at least partly pull out the blockish inside pads for the right and left cheeks from the interior of the head protecting cap portion, a pair of right and left pad-pull members, having pulling means exposed to the outer surfaces of the blockish inside pads, are respectively attached to the blockish inside pads for the right and left cheeks. According to the helmet of the prior patent reference, at least one blockish inside pad is attached to the head protecting cap portion with a plurality of recess-projection fitting mechanisms. The plurality of recess-projection fitting mechanisms include one male hook disposed on at least one blockish inside pad side and a female hook disposed on the head protecting cap portion side to be able to recess-projection fit with the male hook. Also, each pad-pull member has an intruding portion capable of intruding between the male hook and the female hook which recess-projection fits with the male hook, and the pulling means. By pulling the pulling means, the intruding portion intrudes between the male hook and female hook to disengage them from each other. Also, the intruding portion catches the male hook to pull it to the outside of the head protecting cap portion at least halfway, so that at least one blockish inside pad is taken out from the interior of the head protecting cap portion at least partly.

In the helmet of the prior patent reference, however, the intruding portion of the comparatively large-sized pad-pull member must be interposed between an impact-on-the-chin-and-cheek absorbing liner and the blockish inside pad for the cheek. This interposing operation is cumbersome. Unless the intruding portion is interposed correctly to intrude between the male hook and female hook reliably, the blockish inside pad cannot be taken out from the interior of the head protecting cap portion easily and reliably.

SUMMARY OF THE INVENTION

The present invention has been made to correct the drawback as described above of the helmet of the prior patent reference effectively with a comparatively simple arrangement.

It is, therefore, an object of the present invention to provide a helmet in which at least one blockish inside pad can be taken out of the interior of a head protecting cap portion at least partly by pulling it out from the interior of the head protecting cap portion at least partly even if the helmet is difficult to remove from the head of the helmet wearer, so that the head protecting cap portion can be removed from the head with a comparatively small force, and the operation of removing the helmet can be performed easily and reliably with a comparatively simple arrangement, and a method of removing the helmet.

It is another object of the present invention to provide a helmet in which, when pulling at least one blockish inside pad from the interior of a head protecting cap portion outward at least partly, the recess-projection fitting of all of a plurality of recess-projection fitting mechanisms need not be disengaged at least at the initial time point, so that when pulling at least one blockish inside pad from the interior of the head protecting cap portion outward, the recess-projection fitting of the recess-projection fitting mechanisms can be disengaged (and at least one blockish inside pad can be pulled out) easily and reliably, and a method of removing the helmet.

It is still another object of the present invention to provide a helmet in which the recess-projection fitting of one remaining recess-projection fitting mechanism (more particularly, the first recess-projection fitting mechanism to be described later) that has not yet been disengaged at the initial time point can also be disengaged, so that at least one blockish inside pad can be entirely taken out from the interior of the head protecting cap portion easily and reliably, and a method of removing the helmet.

It is still another object of the present invention to provide a helmet in which a blackish inside pad has a comparatively simple structure and comparatively large strength and a cushion member can be taken out of and put in the bag-like member of the blackish inside pad easily, so that an old cushion member can be exchanged for a new cushion member or the size or shape of the internal space of a head protecting cap portion can be changed easily by exchanging the old cushion member for a cushion member having substantially the same shape as or a different shape from the cushion member taken out from the bag-like member and putting the same- or different-shaped new cushion member in the bag-like member, the blackish inside pad can be attached to the head protecting cap portion side reliably and accurately and an attaching structure for the blackish inside pad can be simplified, and a method of removing the helmet.

According to the first aspect of the present invention, there is provided a helmet comprising a head protecting cap portion with one or a plurality of blackish inside pads disposed therein, the at least one blackish inside pad being attached to the head protecting cap portion by one or a plurality of recess-projection fitting mechanisms, the at least one recess-projection fitting mechanism including one hook of a male hook and a female hook which are disposed on the at least one blackish inside pad side, and the other hook disposed on the head protecting cap portion side to be engageable with the one hook by recess-projection engagement, and by pulling the at least one blockish inside pad outward from inside the head protecting cap portion at least partly, the one hook being released relatively from the other hook, thus disengaging the one hook from the other hook, so that the at least one blockish inside pad is pulled outward from the inside the head protecting cap portion at least partly, characterized by comprising a recess-projection fitting disengaging slant surface disposed in the vicinity of the one hook on the at least one blockish inside pad side and/or in the vicinity of the other hook on the head protecting cap portion side, so that when a force to pull out the at least one blockish inside pad from inside the head protecting cap portion acts on the at least one blockish inside pad, the one hook is levitated relatively from the other hook.

According to the first aspect of the present invention, preferably, the at least one blockish inside pad comprises a blockish inside pad for a left cheek and/or a blockish inside pad for a right cheek. Preferably, the at least one blockish inside pad is provided with a pad-pull member to pull the at least one blockish inside pad outward from inside the head protecting cap portion at least partly.

According to the first aspect of the present invention, preferably, a longitudinal projection and a longitudinal recess in which the longitudinal projection can be inserted are disposed in one and the other one, respectively, of the vicinity of the one hook and the vicinity of the other hook, the longitudinal projection comprises a high-level surface and a first recess-projection fitting disengaging slant surface continuous to one end of the high-level surface to be gradually low, and the longitudinal recess comprises a low-level surface having a shape and a position substantially corresponding to those of the high-level surface, and a second recess-projection fitting disengaging slant surface having a shape and a position substantially corresponding to those of the first recess-projection fitting disengaging slant surface and continuous to one end of the low-level surface to be gradually high. Preferably, the recess-projection fitting disengaging slant surface developed to a plane has a slant angle falling within a range of 11° to 40° (more preferably 12° to 38°). Preferably, the recess-projection fitting disengaging slant surface developed to a plane has a width falling within a range of 0.6 mm to 1.5 mm (more preferably 0.8 mm to 1.3 mm). Preferably, the recess-projection fitting disengaging slant surface developed to a plane has a length in a horizontal direction falling within a range of 3 mm to 9.5 mm (more preferably 3.2 mm to 8.8 mm). Preferably, each of the high-level surface and the low-level surface which are developed to a plane has a length in the horizontal direction falling within a range of 2 mm to 7 mm (more preferably 2.4 mm to 6.5 mm). Preferably, each of the high-level surface and the low-level surface which are developed to a plane has a length in a vertical direction falling within a range of 1.5 mm to 2.8 mm (more preferably 1.6 mm to 2.5 mm).

According to one aspect of the present invention, preferably, the recess-projection fitting mechanism comprises a plurality of recess-projection fitting mechanisms, and when the at least one blockish inside pad is pulled outward from inside the head protecting cap portion at least partly, a first recess-projection fitting mechanism comprising one of the plurality of recess-projection fitting mechanisms serves as a pivot fulcrum for pivoting the blockish inside pad forward with respect to the head protecting cap portion. In this case, preferably, when the blockish inside pad is pivoted forward about the first recess-projection fitting mechanism as a fulcrum and thereafter the at least one blockish inside pad is pulled further outward from inside the head protecting cap portion, the first recess-projection fitting mechanism which has been recess-projection fitted is disengaged by the recess-projection fitting disengaging slant surface.

According to the first aspect of the present invention, preferably, the at least one blockish inside pad comprises at least one thick plate-like cushion member and a bag-like member which covers the cushion member like a bag, the bag-like member comprises a bag main body including an opening, through which the cushion member can be loaded and unloaded, in one surface thereof, and a plurality of holding members each of which is formed of a thin plate-like elastic material and covers the opening at least partly, part of a peripheral portion of each of the plurality of holding members being attached to the bag main body on part of a peripheral portion of the opening, at least one recess-projection engaging mechanism detachably engages the plurality of holding members with each other, and the at least one recess-projection engaging mechanism comprising one hook provided to at least one holding member of the plurality of holding members, and an engaging hole formed in at least another one holding member of the plurality of holding members so as to detachably engage with the one hook. Preferably, the helmet comprises a full-face-type helmet.

According to the second aspect of the present invention, the present invention relates to a method of removing, from a head of a helmet wearer, a helmet comprising a head protecting cap portion with one or a plurality of blockish inside pads disposed therein, comprising: attaching the at least one blockish inside pad to the head protecting cap portion in advance by one or a plurality of recess-projection fitting mechanisms, when attaching the at least one blockish inside pad, using the at least one recess-projection fitting mechanism including one hook of a male hook and a female hook which are disposed on the at least one blockish inside pad side, and the other hook disposed on the head protecting cap portion side to be engageable with the one hook by recess-projection engagement, when removing the helmet worn on the head of the helmet wearer, first, pulling the at least one blockish inside pad outward from inside the head protecting cap portion to release the one hook relatively from the other hook, thus disengaging the one hook from the other hook, and pulling the at least one blockish inside pad outward from inside the head protecting cap portion at least partly, and removing the head protecting cap portion from the head of the helmet wearer, characterized by disposing a recess-projection fitting disengaging slant surface which can cause the one hook to levitate relatively from the other hook, when a force to pull out the at least one blockish inside pad from inside the head protecting cap portion acts on the at least one blockish inside pad, in advance in the vicinity of the one hook on the at least one blockish inside pad side and/or in the vicinity of the other hook on the head protecting cap portion side.

The above, and other, objects, features and advantages of the present invention will become readily apparent from the following detailed description thereof which is to be read in connection with the accompanying drawings.

DETAILED DESCRIPTION OF THE INVENTION

An embodiment in which the present invention is applied to a full-face-type helmet will be described with reference to drawings in "1. Schematic Composition of Helmet as a Whole", "2. Composition of Blockish Inside Pad for Cheek", "3. Composition of Pad-pulling Member", "4. Composition of Attaching Portion of Impact-on-the-chin-and-cheek Absorbing Liner" and "5. Helmet Removing Operation".

1. Schematic Composition of Helmet as a Whole

Figure 1:
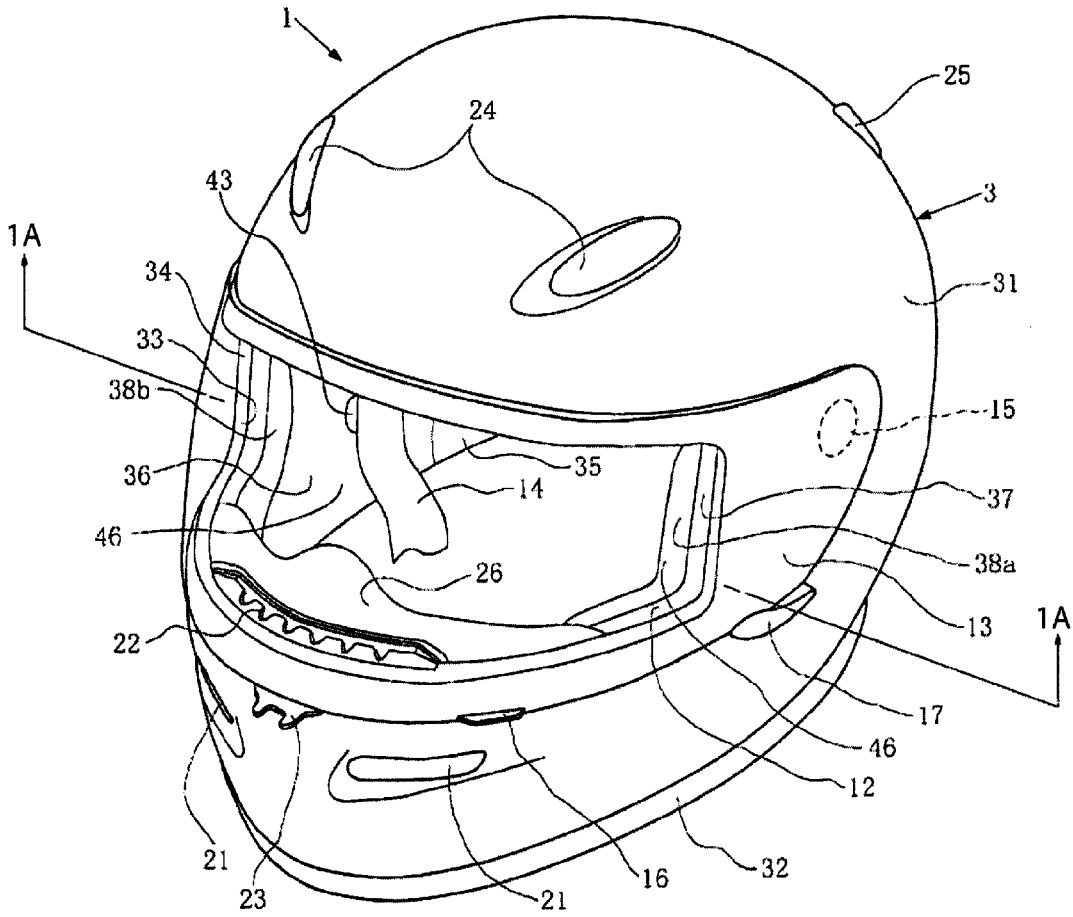
FIG. 1 is an overall perspective view of a helmet in an embodiment in which the present invention is applied to a full-face-type helmet.
Figure 1A:
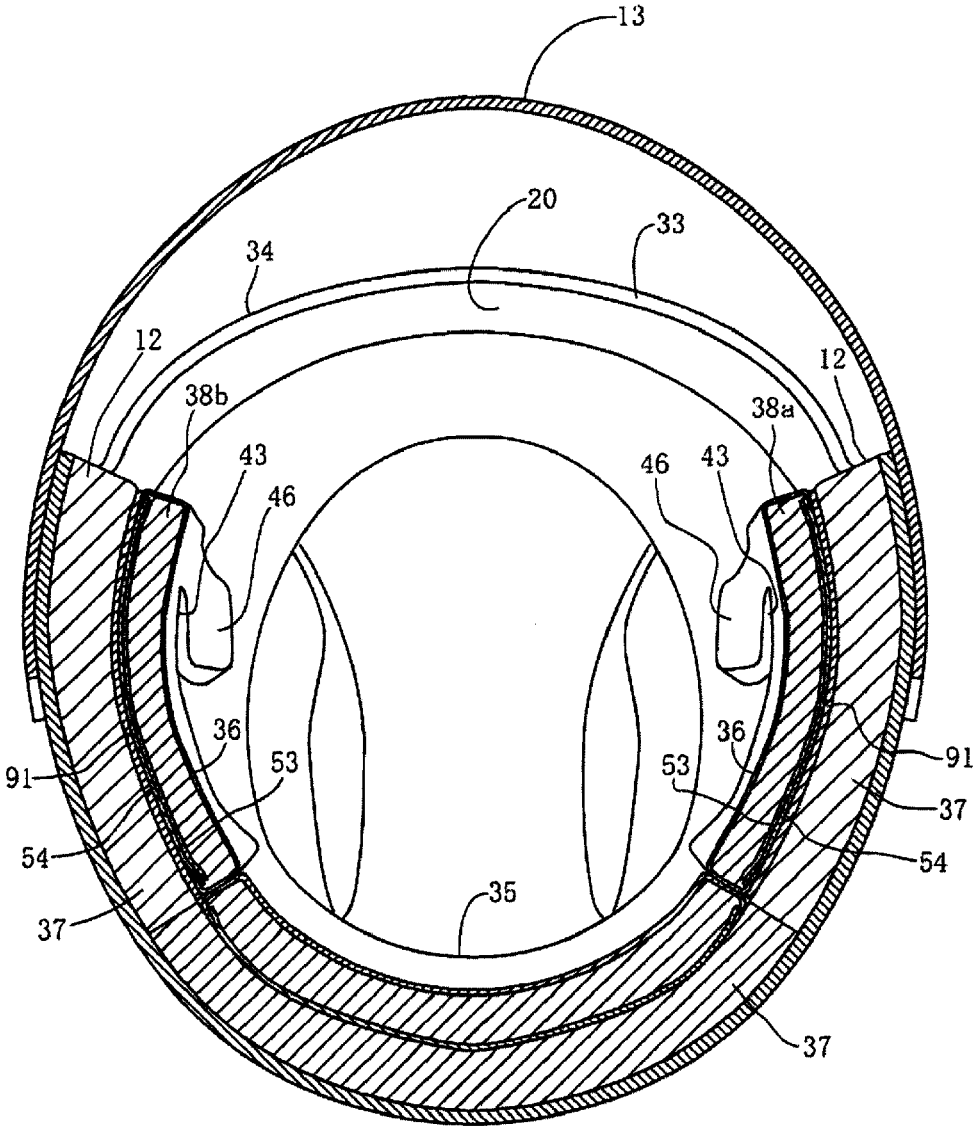
FIG. 1A is a cross sectional view taken on line 1A-1A of FIG. 1.
Figure 15:
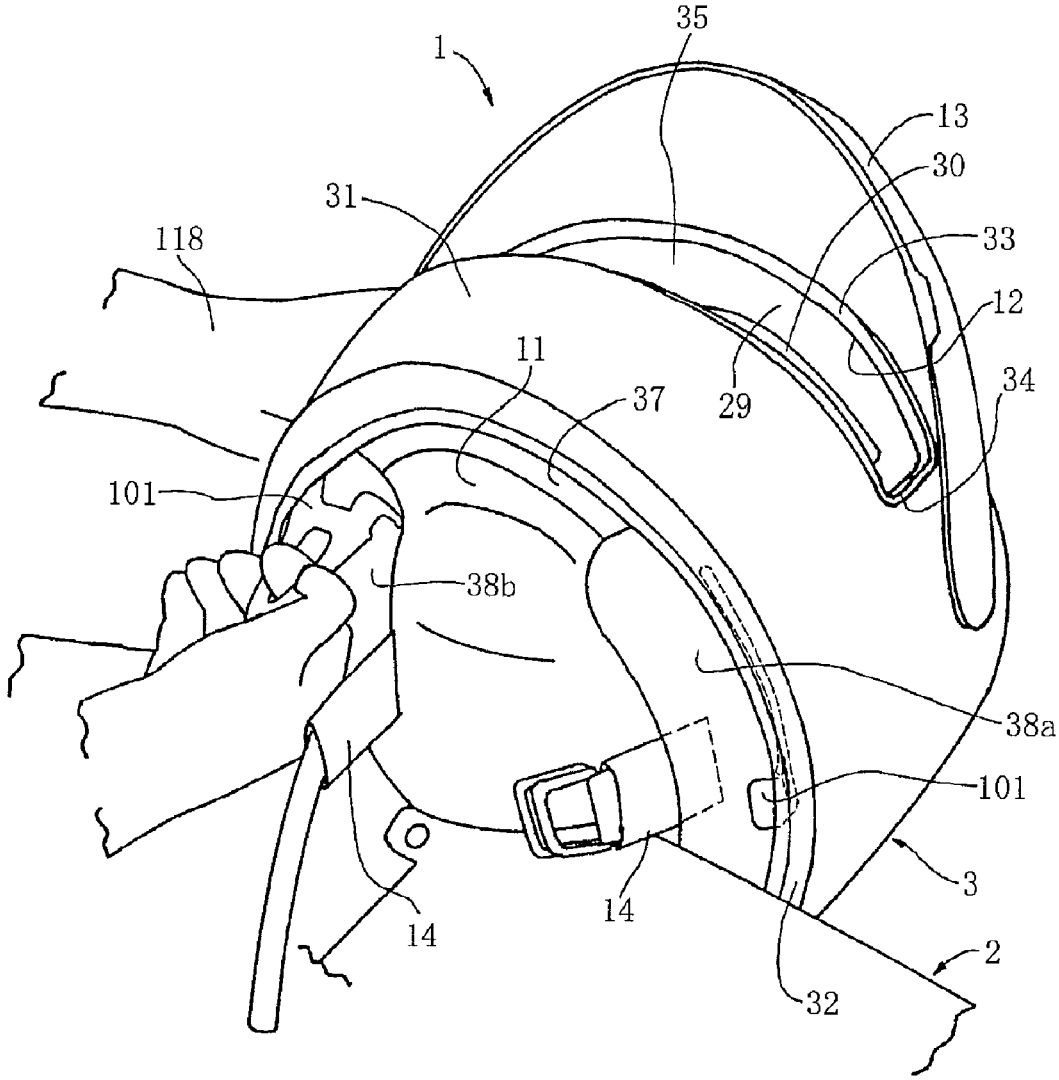
FIG. 15 is a schematic perspective view showing the worn state of the helmet in FIG. 5 in the process of pulling out the blockish inside pad for the right cheek shown in FIG. 4, which is in the first state, from the attaching portion shown in FIG. 3.
Figure 16:
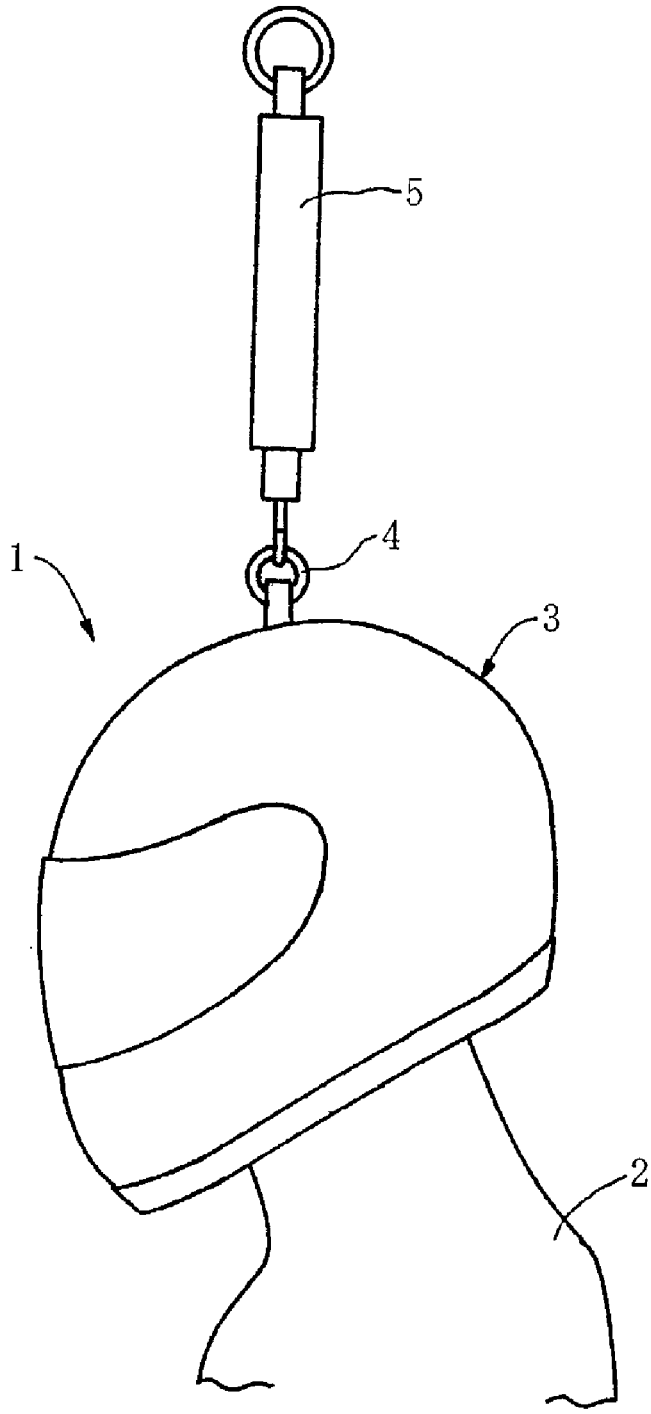
FIG. 16 PRIOR ART
FIG. 16 is a schematic right side view showing an experiment aimed at measuring the force required to remove a conventional full-face-type helmet in the worn state.

As shown in FIGS. 1 and 15, a full-face-type helmet 1 is made up of:

(a) a full-face-type head protecting cap portion 3 to be worn on a head 11 of a helmet wearer 2, e.g., the rider of a motor cycle, (b) a shield 13 capable of opening/closing a window opening 12 formed in the front surface of the head protecting cap portion 3 to oppose the portion (i.e., the center portion of the face) between the forehead and chin of the helmet wearer 2, and (c) a pair of right and left chin straps 14 attached to the interior of the head protecting cap portion 3.

As has been conventionally known, the shield 13 may be made of a transparent or translucent hard material such as polycarbonate or another type of hard synthetic resin. The regions including the right and left end portions and their vicinities of the shield 13 are pivotally mounted on the head protecting cap portion 3 with a pair of right and left mounting screws 15. The shield 13 closes the window opening 12 at the backward pivoting position shown in FIG. 1, and opens the window opening 12 at the forward pivoting position to which the shield 13 has pivoted upward from the backward pivoting position. At the intermediate position between these two positions, the shield 13 can partly open the window opening 12. In FIG. 1, a tap 16 is formed on the shield 13 to be held by the helmet wearer 2 with his fingers when the helmet wearer 2 is to pivot upward and downward the shield 13 forward and backward. An operating lever 17 is formed on the head protecting cap portion 3 to be held by the helmet wearer 2 with his fingers and operated when the helmet wearer 2 is to pivot slightly upward and forward the shield 13 located at the backward pivoting position.

As is conventionally known, if necessary, the head protecting cap portion 3 shown in FIGS. 1 and 15 may incorporate one or a plurality of types of ventilator mechanisms. In FIG. 1, a pair of right and left air supply ports 21 also serving as exhaust ports are formed in the chin region of the head protecting cap portion 3 opposing the chin of the helmet wearer 2. An outlet port forming member 22 forms an outlet port through which air introduced from the air supply ports 21 flows upward along the inner surface of the shield 13. An operating tap 23 operates a shutter that opens/closes the outlet port formed by the outlet port forming member 22. A pair of right and left air supply port opening/closing shutters 24 are formed in the forehead region of the head protecting cap portion 3 opposing the forehead of the helmet wearer 2. A pair of right and left exhaust port opening/closing shutters 25 are formed in the occiput region of the head protecting cap portion 3 opposing the occiput of the helmet wearer 2. A breath guard 26 is formed in a region including the chin region and its vicinity of the head protecting cap portion 3 to be adjacent to the outlet port forming member 22.

As shown in FIGS. 1 and 15, the head protecting cap portion 3 is made up of:

(a) a full-face-type outer cap shell 31 which forms the circumferential wall of the head protecting cap portion 3, (b) a lower rim member 32 having e.g., a substantially U-shaped cross-section and fixed to the outer cap shell 31 throughout the lower end portion of the outer cap shell 31 with an adhesive or the like, (c) a rim member 34 for the window opening which has e.g., a substantially E-shaped section and is fixed to the outer cap shell 31 throughout the circumference of a window opening 33 with an adhesive or the like in order to form the window opening 12 of the head protecting cap portion 3, (d) a backing member 35 for the head which is fixed to the outer cap shell 31 with an adhesive or the like in contact with the inner surface of the outer cap shell 31 in a forehead region, a vertex region, right and left temple regions and occiput region respectively corresponding to the forehead part, vertex part, right and left temple parts and occiput part of the head of the helmet wearer 2, and (e) a backing member 36 for the chin and cheeks which is fixed to the outer cap shell 31 with an adhesive or the like in contact with the inner surface of the outer cap shell 31 in chin and cheek regions respectively corresponding to the chin and cheeks of the helmet wearer 2.

The outer cap shell 31 can be made of a composite material. More specifically, the outer cap shell 31 can be formed by lining the inner surface of a strong shell body made of a hard synthetic resin, e.g., FRP, with a flexible sheet such as a porous nonwoven fabric. The lower rim member 32 can be made of a soft synthetic resin such as foamed vinyl chloride or synthetic rubber. The rim member 34 for the window opening can be made of an elastic material with high flexibility such as synthetic rubber.

As shown in FIGS. 1 and 15, the backing member 35 for the head is constituted by an impact-on-the-head absorbing liner 29 and a permeable backing cover 30 for the head which is attached to the impact-on-the-head absorbing liner 29 so as to cover substantially the entire inner surface of the impact-on-the-head absorbing liner 29. As shown in FIGS. 1 and 15, the backing member 36 for the chin and cheeks includes an impact-on-the-chin-and-cheek absorbing liner 37, and a pair of right and left blockish inside pads **38*b* and 38*a* for cheeks which are attached to the impact-on-the-chin-and-cheek absorbing liner 37 in contact with its inner surface in right and left cheek regions respectively corresponding to the right and left cheeks of the helmet wearer 2**.

Each of the body portions of the impact-on-the-head absorbing liner 29 and impact-on-the-chin-and-cheek absorbing liner 37 shown in FIGS. 1 and 15 can be made of a material with appropriate rigidity and appropriate plasticity such as foamed polystyrene or another synthetic resin. The body portion of the backing cover 30 for the head can be made of a combination of a woven fabric and a porous nonwoven fabric by laminating a layer with an appropriate shape, which is made of an elastic material with high flexibility such as urethane foam or another synthetic resin, on the surface (i.e., the outer surface) opposing the impact-on-the-head absorbing liner 29, or on the both surfaces.

2. Composition of Blockish Inside Pad for Cheek

The pair of right and left blockish inside pads **38*b* and 38*a* for the cheeks are substantially symmetrical to each other. Hence, the blockish inside pad 38*b* for the right cheek will be described hereinafter in detail with reference to FIGS. 2 to 11, and a detailed description on the blockish inside pad 38*a*** for the left cheek will be omitted as needed.

As shown in FIG. 2 and FIGS. 4 to 7, the blockish inside pad **38*b* for the right cheek comprises a pad main body 41 and an elongated engaged member 42 which is attached to a region including the lower end and its vicinity of the pad main body 41 throughout substantially its entire length with a sewing thread, a tape, an adhesive or the like. The pad main body 41 has a notch 43 to exclude an ear region corresponding to the right ear of the helmet wearer 2. Accordingly, the pad main body 41 has a shape corresponding to the right cheek and its vicinity (excluding the right ear) of the helmet wearer 2. The pad main body 41 comprises a thick plate-like cushion member 44 which is formed of one or a plurality of highly flexible elastic members such as urethane foam or another synthetic resin, and a bag-like member 45 which covers the cushion member 44 substantially entirely like a bag. Hence, the cushion member 44 is accommodated in and attached to the bag-like member 45**.

Figure 2:
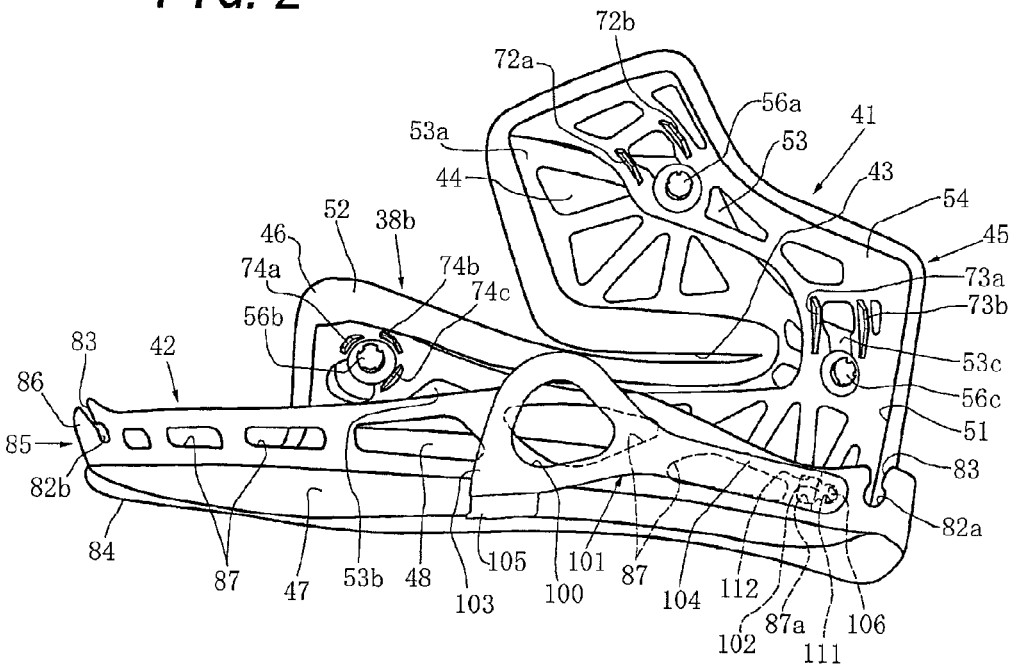
FIG. 2 is a rear view showing a state in which a blockish inside pad alone for a right cheek shown in FIG. 1 is attached to an impact-on-the-chin-and-cheek absorbing liner.

As shown in FIGS. 1 and 2, the surface (i.e., the front surface and, in other words, an inner surface which abuts against the right cheek of the helmet wearer 2) of the bag-like member 45 which is opposite to the surface (i.e., the rear surface) opposing the impact-on-the-chin-and-cheek absorbing liner 37 is substantially entirely formed of a woven fabric portion 46. That one half of the lower surface of the bag-like member 45 which is on the engaged member 42 side is substantially entirely formed of a synthetic leather portion 47 such as vinyl leather. The lower portion of the surface of the bag-like member 45 which opposes the impact-on-the-chin-and-cheek absorbing liner 37 is formed of a porous nonwoven fabric portion 48. The woven fabric portion 46, synthetic leather portion 47 and porous nonwoven fabric portion 48 constitute a bag main body 52 of the bag-like member 45 having an opening 51 which is formed as the upper portion and central portion of that surface of the bag-like member 45 which opposes the impact-on-the-chin-and-cheek absorbing liner 37 continue to each other. The materials of the portions 46, 47 and 48 are not limited to woven fabric, porous or nonporous nonwoven fabric and synthetic leather, respectively, but can be formed of an arbitrary flexible sheet material including the above materials, a synthetic resin sheet, paper, synthetic resin-laminated paper and/or natural leather.

A pair of inner and outer holding members 53 and 54, which are formed of thin plate-like elastic materials and vertically laid on each other, partly cover the opening 51 of the bag main body 52 of the bag-like member 45 shown in FIG. 2. As shown in FIG. 2 and FIGS. 8 to 11, each of the inner and outer holding members 53 and 54 may be formed by fitting a large number of substantially band-like portions integrally to form a thin plate-like shape as a whole. Accordingly, each of the inner and outer holding members 53 and 54 may be obtained by molding with a die or by punching a less flexible elastic material, e.g., a soft synthetic resin such as polypropylene or polyethylene, or paper laminated with such a soft synthetic resin, into an appropriate shape. The thickness of the elastic material (and accordingly each of the inner and outer holding members 53 and 54) is about 1 mm in the embodiment shown in the drawings but, from the viewpoint of practice, generally and preferably falls within a range of 0.2 mm to 2.5 mm and more preferably within a range of 0.4 mm to 1.8 mm.

As shown in FIG. 2 and FIGS. 9 to 11, the inner holding member 53 includes an upper side portion 53*a*, a lower side portion 53*b* and a fitting portion 53*c* which connects the upper and lower side portions 53*a* and 53*b* integrally on the front end side, to form a substantially yoked shape. At the corresponding portions (i.e., part of the outer portion of the inner holding member 53) of the upper side portion 53*a*, lower side portion 53*b* and fitting portion 53*c* which extend along the notch 43, the inner holding member 53 is attached to part of the outer portion of the opening 51 of the bag main body 52 with a sewing thread, a tape, an adhesive or the like. Each of the upper side portion 53*a*, lower side portion 53*b* and fitting portion 53*c* of the inner holding member 53 has one or a plurality of openings 55. As shown in FIG. 2, male portions (i.e., male hooks serving as engaging projections or fitting projections) 56*a*, 56*b* and 56*c* of round hooks 50*a*, 50*b* and 50*c* serving as recess-projection fitting mechanisms are attached to regions including the rear ends and their the vicinities of the upper and lower side portions 53*a* and 53*b*, and the fitting portion 53*c*, respectively, by fixing with rivets 58 (see FIG. 14) or the like.

As shown in FIGS. 2, 8, 10 and 11, the outer holding member 54 includes an upper side portion 54*a*, lower side portion 54*b* and fitting portion 54*c* which connects the upper and lower side portions 54*a* and 54*b* integrally on the front end side, to form a substantially yoked shape. At the corresponding portions (i.e., part of the outer portion of the holding member 54) of the upper side portion 54*a*, the lower side portion 54*b* and the fitting portion 54*c* which are other than the lower end of the upper side portion 54*a*, the upper end of the lower side portion 54*b* and the rear end of the fitting portion 54*c*, the outer holding member 54 are attached to the outer portion of the opening 51 of the bag main body 52 with a sewing thread, a tape, an adhesive or the like. Each of the upper side portion 54*a*, lower side portion 54*b* and fitting portion 54*c* of the outer holding member 54 has a plurality of openings 57. An opening 57*a* in a region including the rear end and its vicinity of the upper side portion 54*a* forms a longitudinal upper potbelly hole having a small hole portion 61, a large hole portion 62 and a communicating portion 63 through which the small hole portion 61 and large hole portion 62 communicate with each other. The small hole portion 61 is arranged to correspond to the upper male hook 56*a*. An opening 57*b* in a region including the rear end and its vicinity of the lower side portion 54*b* forms a lower potbelly hole having a small hole portion 64 and a large hole portion 65 continuous to the small hole portion 64. The small hole portion 64 is arranged to correspond to the lower male hook 56*b*. An opening 57*c* in a region including the upper side and its vicinity of the front portion 54*c* forms a front potbelly hole having a small hole portion 66, a large hole portion 67 and a communicating portion 68 through which the small hole portion 66 and large hole portion 67 communicate with each other. The small hole portion 66 is arranged to correspond to the front male hook 56*c*.

Figure 8:
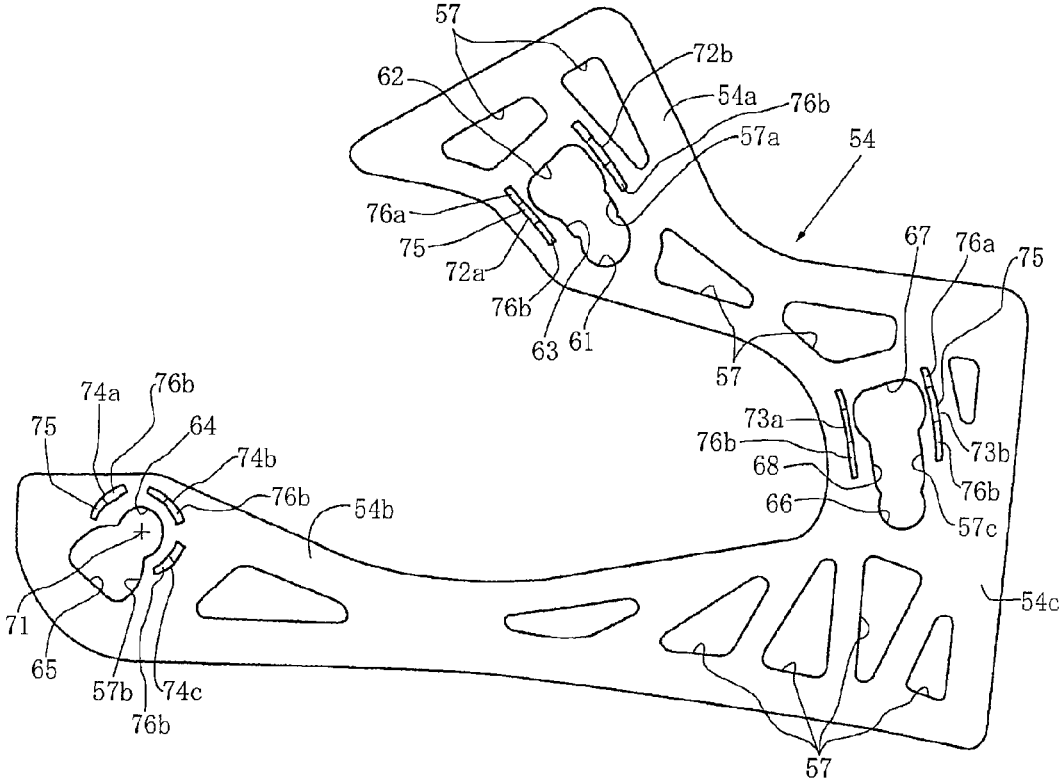
FIG. 8 is an enlarged front view of an outer holding member shown in FIG. 2.
Figure 9:
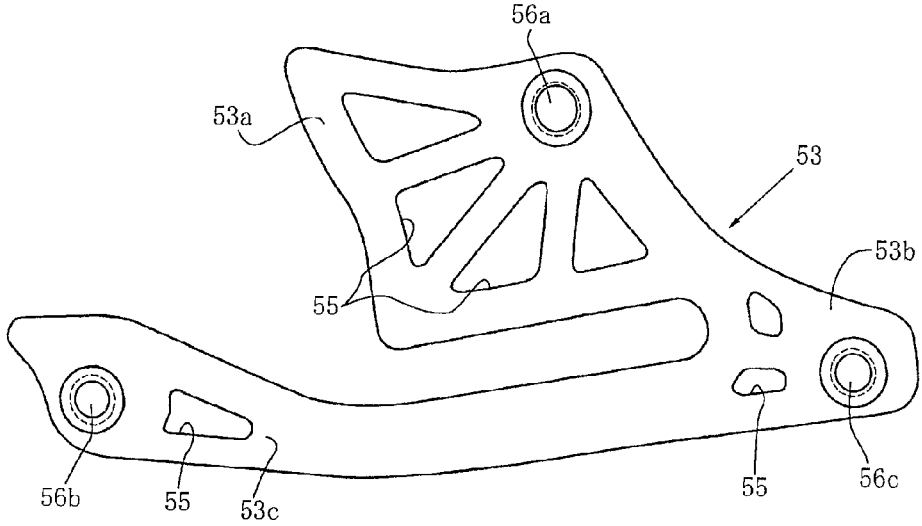
FIG. 9 is an enlarged front view of an inner holding member shown in FIG. 2.
Figure 10:
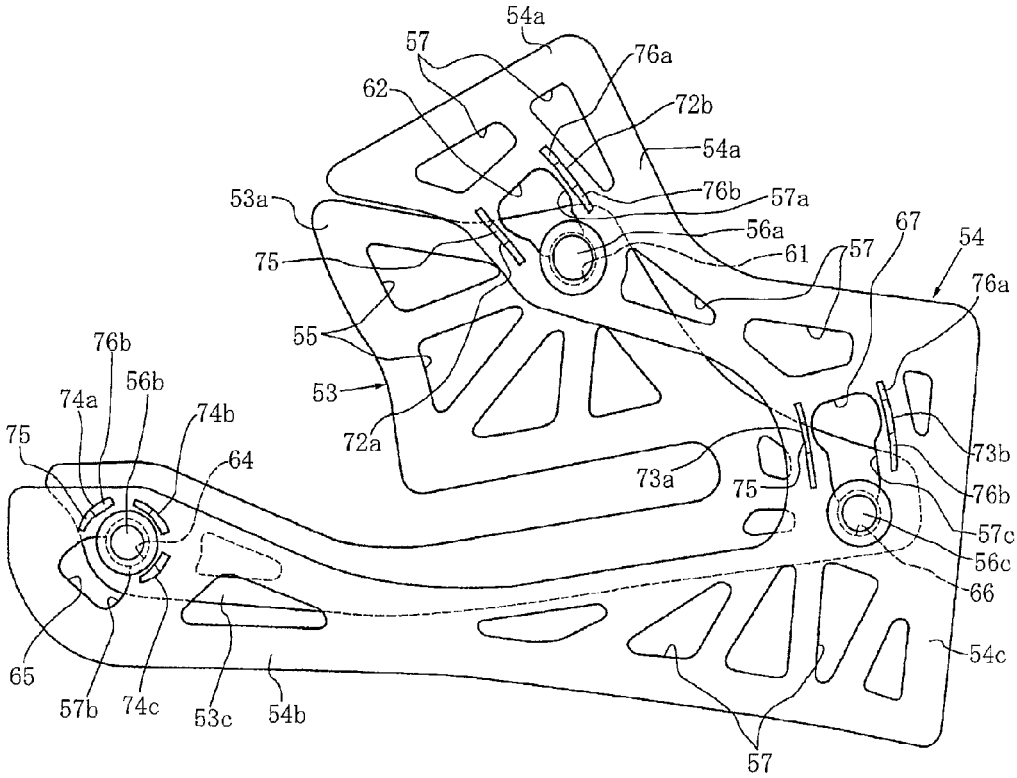
FIG. 10 is an enlarged front view of the outer and inner holding members shown in FIG. 2 in the attached state shown in FIG. 2.
Figure 11:
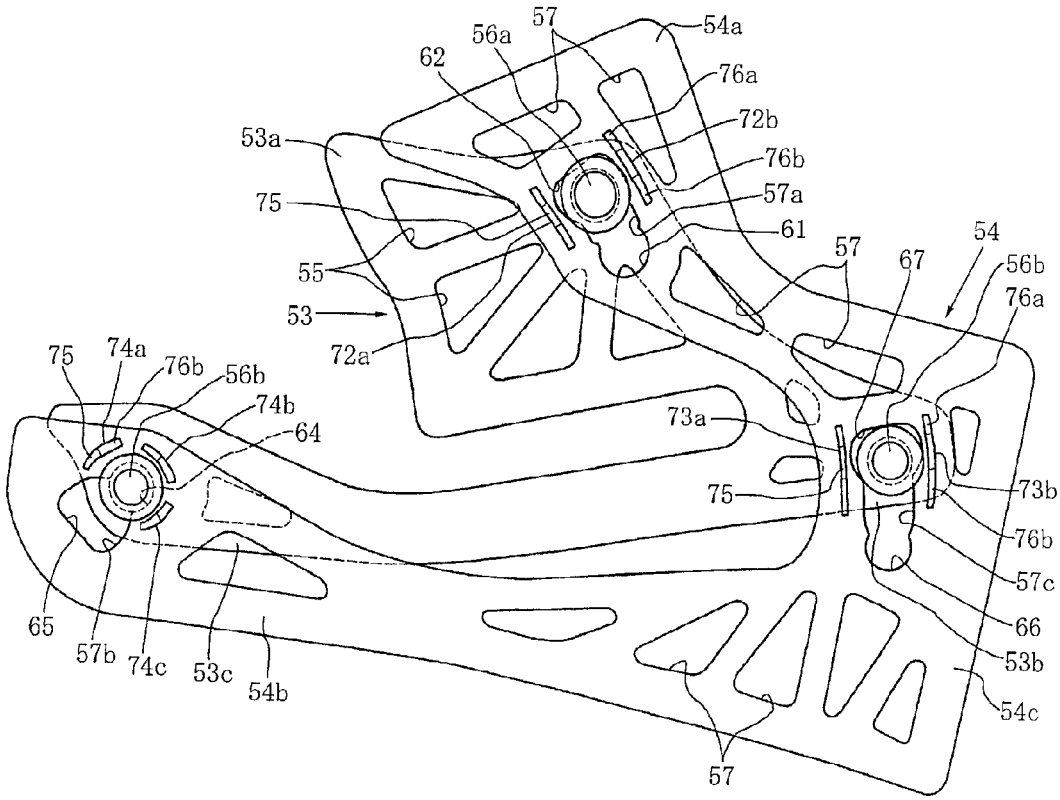
FIG. 11 is a front view of the outer and inner holding members shown in FIG. 2 in the second state shown in FIG. 6.
Figure 12:
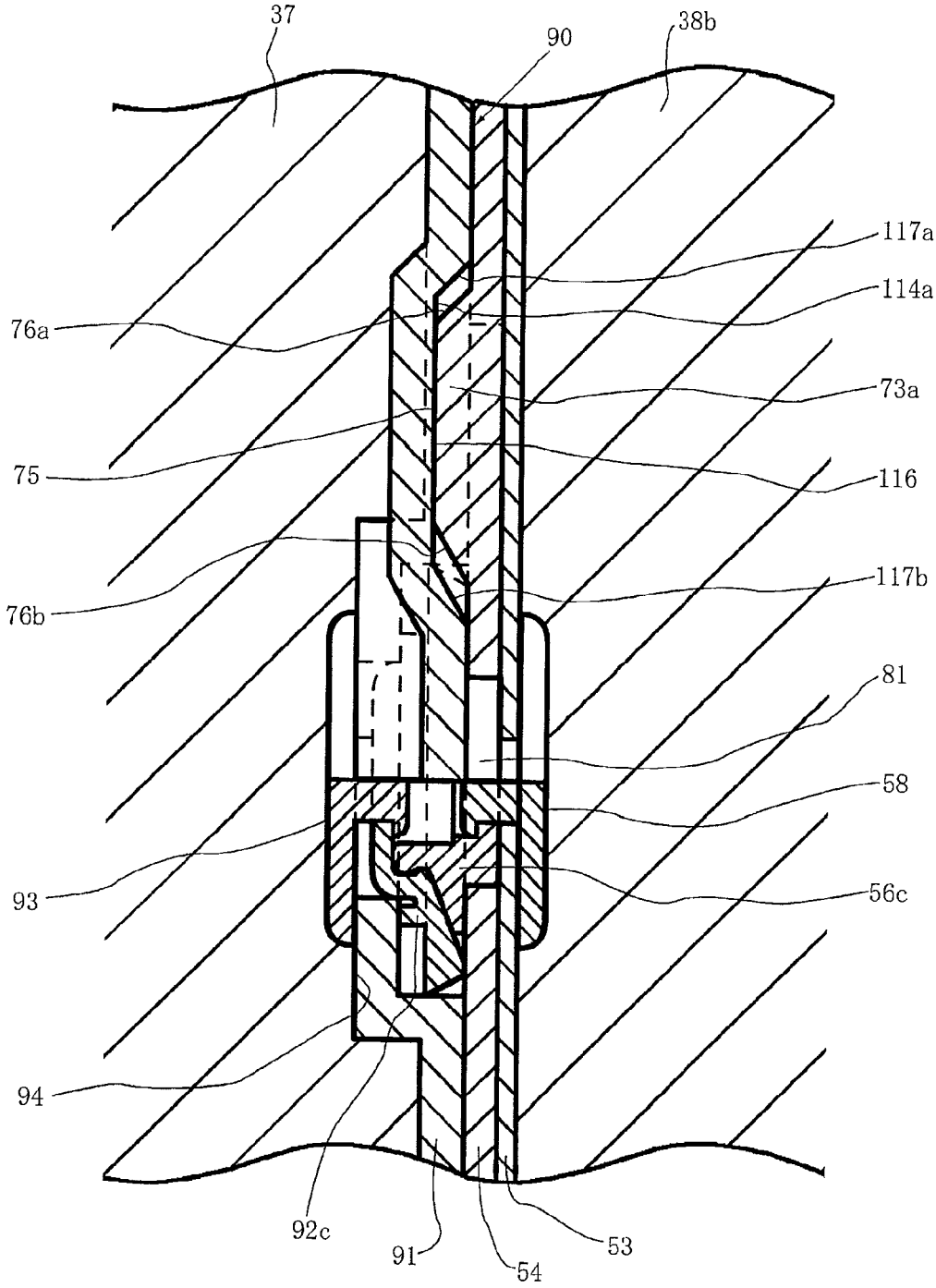
FIG. 12 is an enlarged sectional view taken along the line A-A of FIG. 4.
Figure 13:
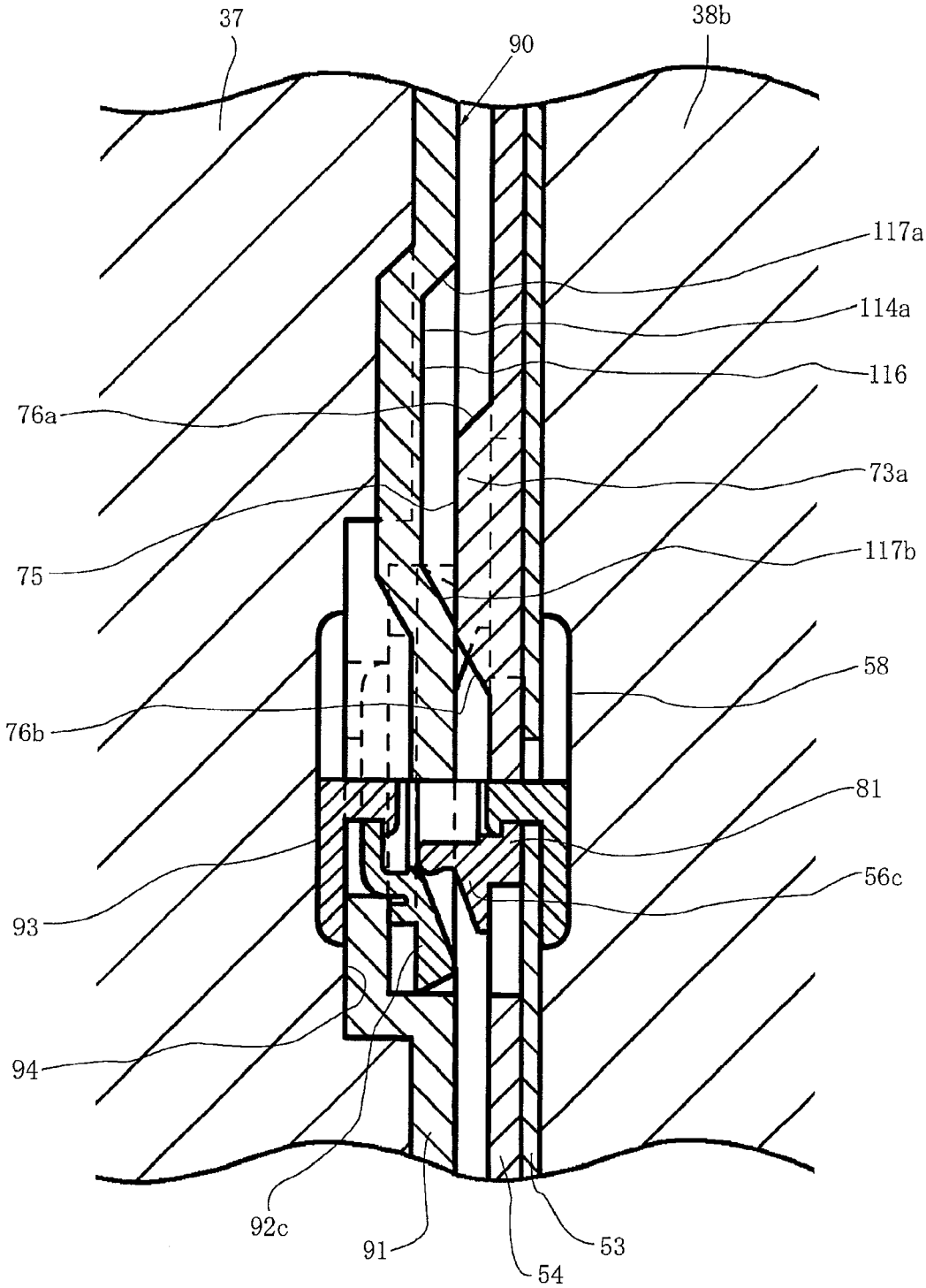
FIG. 13 is an enlarged sectional view taken along the line B-B of FIG. 6.
Figure 14:
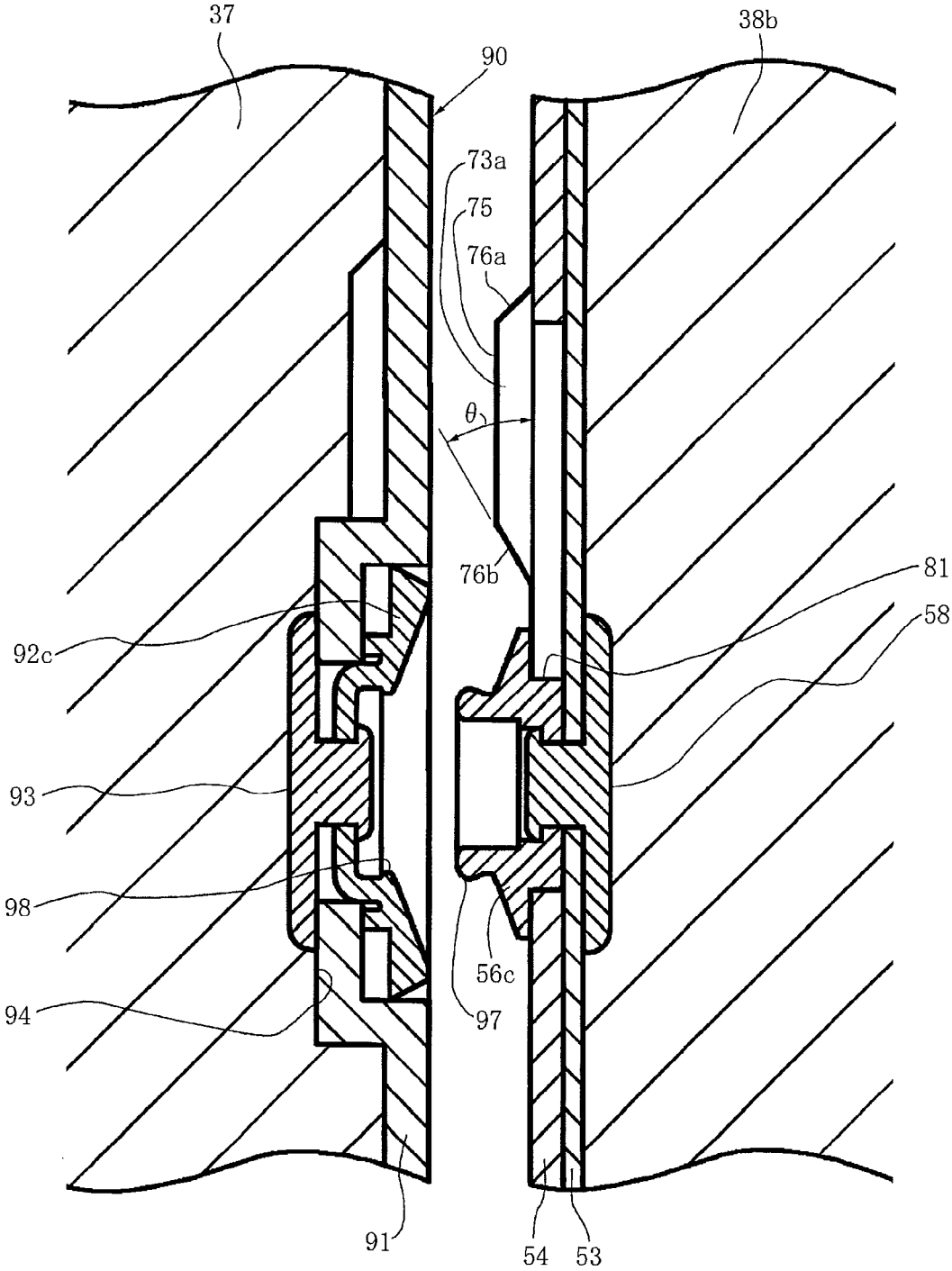
FIG. 14 is an enlarged sectional view taken along the line C-C of FIG. 4.

As shown in FIGS. 8, 10 and 11, each of the upper potbelly hole 57*a* and front potbelly hole 57*c* extends to substantially form an arc about a center point 71 of the small hole portion 64 of the lower potbelly hole 57*b* as the center. The large hole portions 62, 65 and 67 of the upper, lower and front potbelly holes 57*a* to 57*c* are used to engage the male hooks 56*a* to 56*c* with the corresponding potbelly holes 57*a* to 57*c*. More specifically, first, the male hooks 56*a* to 56*c* are guided into the large hole portions 62, 65 and 67 of the potbelly holes 57*a* to 57*c*. Subsequently, as shown in FIGS. 12 and 14, the male hooks 56*a* and 56*c* are guided into the small hole portions 61 and 66 through the communicating portions 63 and 68, and the male hook 56*b* is guided into the small hole portion 64 directly. In FIG. 13, the male hook 56*c* is located at a region including the boundary and its vicinity of the large hole portion 67 and communicating portion 68 of the potbelly hole 57*c*. On the outer surface of the outer holding member 54 (i.e., on the impact-on-the-chin-and-cheek absorbing liner 37 side), as shown in FIG. 8, a pair of guided longitudinal projections 72*a* and 72*b* that can be thin plates are formed on the two sides of the large hole portion 62 and communicating portion 63 of the potbelly hole 57*a* by integral molding. On the outer surface of the outer holding member 54, as shown in FIG. 8, a pair of guided longitudinal projections 73*a* and 73*b* which can be thin plates are formed on the two sides of the large hole portion 67 and communicating portion 68 of the potbelly hole 57*c* by integral molding. Furthermore, on the outer surface of the outer holding member 54, as shown in FIG. 8, three guided longitudinal projections 74*a*, 74*b* and 74*c* which can be thin plates are formed by integral molding to substantially surround the small hole portion 64 of the potbelly hole 57*b* as a whole. The guided longitudinal projections 72*a*, 72*b*, 73*a*, 73*b* and 74*a* to 74*c* are arranged to extend to substantially, respectively form arcs about the center point 71 of the small hole portion 64 of the lower potbelly hole 57*b* as the center. As shown in FIG. 14, each of the guided longitudinal projections 72*a*, 72*b*, 73*a* and 73*b* has a substantially flat high-level surface 75 and a pair of slant surfaces 76*a* and 76*b* which continue to the two ends of the high-level surface 75 to be gradually low. Each of the guided longitudinal projections 74*a* to 74*c* has a substantially flat high-level surface 75 and a slant surface 76*b* which continues to one end of the high-level surface 75 to be gradually low.

The slant surfaces 76*b* of the guided longitudinal projections 72*a*, 72*b*, 73*a*, 73*b* and 74*a* to 74*c* serve as recess-projection fitting disengaging slant surfaces which release the male hooks 56*a* to 56*c* of the round hooks 50*a* to 50*c* serving as the recess-projection fitting mechanisms relatively from female hooks 92*a* to 92*c* (to be described later), thus disengaging them from each other. The slant surfaces 76*a* and 76*b* of each of the guided longitudinal projections 72*a*, 72*b*, 73*a*, 73*b* and 74*a* to 74*c* are slanted with a substantially uniform slant angle θ (see FIG. 14) from the outer surface of the holding member 54 to that end of the high-level surface 75 of the corresponding guided longitudinal projection.

When the guided longitudinal projections 72*a*, 72*b*, 73*a*, 73*b* and 74*a* to 74*c* are developed to a plane, in the case of the embodiment shown in the drawings, the thickness of each guided longitudinal projection is about 1 mm. The slant angle θ of each of the longitudinal projections 72*a*, 72*b* and 74*a* to 74*c* is about 30°. The slant angle θ of each of the longitudinal projections 73*a* and 73*b* is about 15°. The length of the slant surface 76*b* of each of the longitudinal projections 72*a*, 72*b* and 74*a* to 74*c* is about 4 mm. The length of the slant surface 76*b* of each of the longitudinal projections 73*a* and 73*b* is about 7 mm. The length of the high-level surface 75 of each of the longitudinal projections 72*a*, 72*b*, 73*a* and 73*b* is about 5 mm. The length of the high-level surface 75 of each of the longitudinal projections 74*a* to 74*c* is about 3 mm. The height of the high-level surface 75 (in other words, the highest portion of the slant surfaces 76*a* and 76*b*) of each of the longitudinal projections 72*a*, 72*b*, 73*a*, 73*b* and 74*a* to 74*c* is about 2 mm.

According to the present invention, from the viewpoint of practice, generally, concerning the numerical values described above, one, a plurality, or all of the numerical ranges described in the following items (a) to (e) are preferably satisfied (the descriptions of the following items (a) to (e) apply when the longitudinal projections are developed to a plane):

(a) the thickness (and accordingly the width) of each of the longitudinal projections 72*a*, 72*b*, 73*a*, 73*b* and 74*a* to 74*c* (and accordingly the slant surface 76*b*) falls within a range of 0.6 mm to 1.5 mm (more preferably a range of 0.8 mm to 1.3 mm), (b) the slant angle θ of the slant surface 76*b* of each of the longitudinal projections 72*a*, 72*b*, 73*a*, 73*b* and 74*a* to 74*c* falls within a range of 11° to 40° (more preferably a range of 12° to 38°), (c) the length (in other words, the length in the horizontal direction) of the slant surface 76*b* of each of the longitudinal projections 72*a*, 72*b*, 73*a*, 73*b* and 74*a* to 74*c* falls within a range of 3 mm to 9.5 mm (more preferably a range of 3.2 mm to 8.8 mm), (d) the length (in other words, the length in the horizontal direction) of the high-level surface 75 of each of the longitudinal projections 72*a*, 72*b*, 73*a*, 73*b* and 74*a* to 74*c* falls within a range of 2 mm to 7 mm (more preferably a range of 2.4 mm to 6.5 mm), and (e) the height (in other words, the length in the vertical direction) of the high-level surface 75 of each of the longitudinal projections 72*a*, 72*b*, 73*a*, 73*b* and 74*a* to 74*c* falls within a range of 1.5 mm to 2.8 mm (more preferably a range of 1.6 mm to 2.5 mm).

Figure 4:
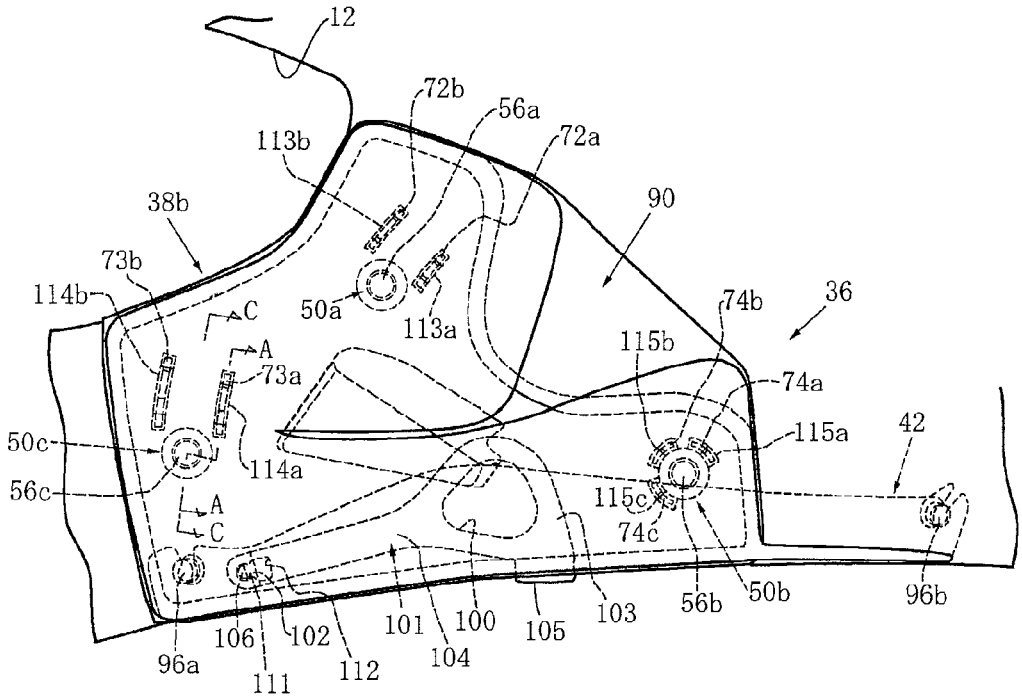
FIG. 4 is a front view showing a state in which the blockish inside pad for the right cheek in FIG. 1 is attached to the attaching portion shown in FIG. 3.

As shown in FIG. 4, small-diameter bases (if the inner holding member 53 and rivets 58 are included, narrow portions) 81 of the male hooks 56*a* to 56*c* respectively, detachably fix in the small hole portions 61, 64 and 66 of the potbelly holes 57*a* to 57*c* by fitting. This couples the inner holding member 53 and outer holding member 54 to each other by detachable recess-projection engagement of the male hooks 56*a* to 56*c* with the small hole portions 61, 64 and 66 of the potbelly holes 57*a* to 57*c*. When fixing the male hooks 56*a* to 56*c* in the small hole portions 61, 64 and 66 of the potbelly holes 57*a* to 57*c* by fitting, after inserting the male hooks 56*a* to 56*c* in the large hole portions 62, 65 and 67 of the potbelly holes 57*a* to 57*c*, the inner holding member 53 is moved relative to the small hole portions 61, 64 and 66 in substantially a planar direction, as described above. This can press-fit the bases (i.e., narrow portions) 81 of the male hooks 56*a* to 56*c* respectively in the small hole portions 61, 64 and 66 very easily, thus engaging and fixing them.

As shown in FIGS. 2 and 4, the longitudinal engaged member 42 has a pair of front and rear notches 82*a* and 82*b* in a region including the front end and its vicinity of the engaged member 42 and in a region including the rear end and its vicinity of the engaged member 42, respectively. When the blockish inside pad 38*b* for the right cheek is attached to the impact-on-the-chin-and-cheek absorbing liner 37 (i.e., the state shown in FIGS. 2 and 4), the pair of notches 82*a* and 82*b* extend upward or obliquely upward to respectively continue to portions around the engaged member 42 through narrow portions 83 respectively formed at the inlets of the pair of notches 82*a* and 82*b*. The rear end of the engaged member 42, together with the bag main body 52, projects more backward than the cushion member 44 of the pad main body 41 to form a backward projection 86 to constitute an inserting portion 85 together with a backward projection 84 of the bag main body 52. The engaged member 42 has a plurality of openings 87 in its longitudinal direction to impart flexibility and reduce the weight. The engaged member 42 can be made of a soft synthetic resin or the like such as polyethylene.

An example of the operation of taking the cushion member 44 out of the blockish inside pad 38*b* for the right cheek shown in FIG. 2 will be described.

Assume that the inside pad 38*b* is alone in the state shown in FIG. 2. First, those portions of the inner holding member 53 which are in regions including the male hooks 56*a*, 56*b* and 56*c* and their vicinities are moved downward, forward and obliquely downward relative to the outer holding member 54 to extract the male hooks 56*a*, 56*b* and 56*c* respectively from the small hole portions 61, 64 and 66 of the potbelly holes 57*a*, 57*b* and 57*c*, and then the inner holding member 53 is brought to above the outer holding member 54. Subsequently, the inner holding member 53 is reversed from the front side to the rear side in FIG. 2 of the cushion member 44 and bag main body 52 with reference to a region including that portion of the pad main body 41, which is around the notch 43, and its vicinity as a reverse line. In the reversal state, the inner holding member 53 is not present on the opening 51, and only the outer holding member 54 is present on the opening 51. Therefore, the cushion member 44 can be taken out of the bag main body 52 very easily while elastically deforming the outer holding member 54 appropriately. When storing the cushion member 44 or another cushion member in the bag main body 52, operation opposite to that described above may be performed.

3. Composition of Pad-Pull Member

As shown in FIGS. 2 and 4, where necessary, one or two of the pair of blockish inside pads 38*a* and 38*b* for the left and right cheeks can be engaged with one or two of a pair of left and right pad-pull members 101, respectively, which are used to pull the pair of blockish inside pads 38*a* and 38*b* for the left and right cheeks out from the interior of the head protecting cap portion 3 at least partly. As the pair of left and right pad-pull members 101 are axi-symmetrical with each other, the right pad-pull member 101 will be described in detail with reference to FIG. 2 and FIGS. 4 to 7. A detailed description on the left pad-pull member 101 will be omitted as needed.

Figure 7:
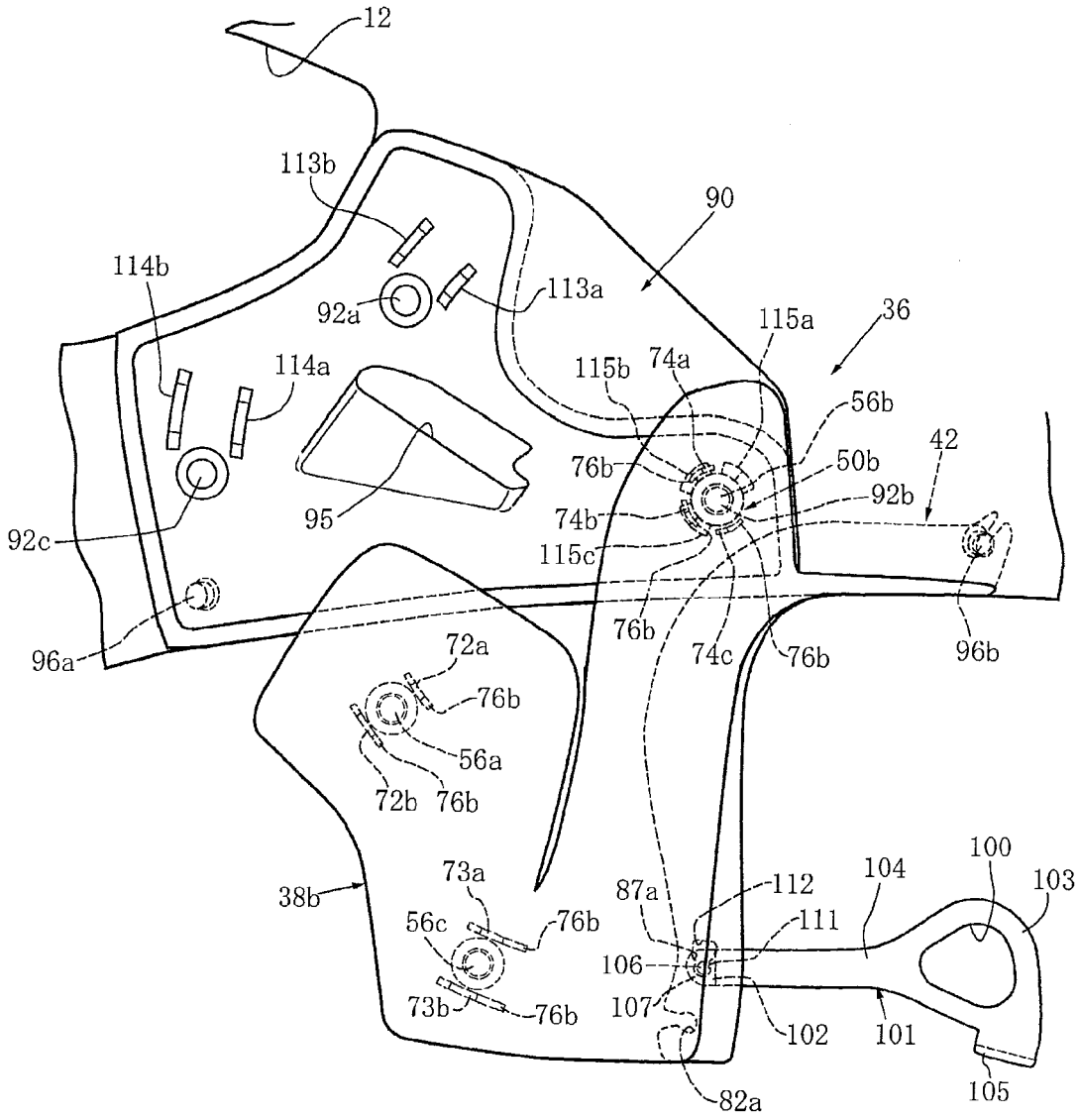
FIG. 7 is a front view, similar to FIG. 4, showing the blockish inside pad for the right cheek in the third state during the process of pulling out the blockish inside pad for the right cheek shown in FIG. 4 from the attaching portion shown in FIG. 3.

As shown in FIGS. 2 and 7, the right pad-pull member 101 includes portions described in the following items (a) to (d):

(a) a locking portion 102 to lock with the blockish inside pad 38*b* for the right cheek, (b) a thin plate-like loop-shaped handle 103 having a finger catch opening 100, (c) a thin plate-like longitudinal fitting portion 104 which connects the locking portion 102 to the handle 103, and (d) a bend portion 105 which is bent with respect to the handle 103 at a substantially right angle or the like so as to engage with the lower surface of the blockish inside pad 38*b* for the right cheek.

The pad-pull member 101 may be made of a product obtained by molding a soft synthetic resin such as polypropylene or polyethylene, or an elastic material such as paper on which such a soft synthetic material is laminated, into an appropriate shape using a die. The pad-pull member 101 is preferably of a color that stands out from the dark-colored inside pad 38*b*, and may be of a reddish color such as red.

As shown in FIGS. 2 and 7, the locking portion 102 of the pad-pull member 101 has a shaft portion 106 formed integrally at the distal end of the fitting portion 104, and a removal preventive flange 107 formed integrally at the distal end of the shaft portion 106. As shown in FIG. 2, an opening 87*a* at a region including the front end and its vicinity of the longitudinal engaged member 42 forms a potbelly hole having a small hole portion 111 and a large hole portion 112 continuous to the small hole portion 111. The shaft portion 106 of the pad-pull member 101 is detachably, pivotally fitted in the small hole portion 111 of the potbelly hole 87*a* by fixing. For this reason, the pad-pull member 101 and engaged member 42 are coupled to each other through detachable recess-projection engagement of the locking portion 102 and the small hole portion 111 of the potbelly hole 87*a*. When engaging the locking portion 102 in the small hole portion 111 of the potbelly hole 87*a* by fixing, after the removal preventive flange 107 and shaft portion 106 of the locking portion 102 are inserted in the large hole portion 112 of the potbelly hole 87*a*, the pad-pull member 101 is moved with respect to the small hole portion 111 substantially in a planar direction. Then, the shaft portion 106 can be pressed into the small hole portion 111 very easily, thus engaging it by fixing. When taking the pad-pull member 101 out of the engaged member 42 (in other words, the blockish inside pad 38*b* for the right cheek), operation opposite to that of the case of attaching described above may be performed.

4. Composition of Attaching Portion of Impact-on-chin-and-cheek Absorbing Liner

As shown in FIGS. 1 and 12, the blockish inside pads 38*a* and 38*b* for the left and right cheeks are attached substantially in contact with inner surfaces (that is, the right and left attaching portions) 90 of the left half and right half, respectively, of the impact-on-the-chin-and-cheek absorbing liner 37. A pair of left and right thin plate-like support members 91 are attached by adhesion, engaging pins with removal preventive rings, or the like to the surfaces of the main body portion of the impact-on-the-chin-and-cheek absorbing liner 37 which are on the side (that is, the inner surface) opposite to the outer cap shell 31, so as to constitute the pair of left and right attaching portions 90 to which the inside pads 38*a* and 38*b* are to be attached respectively. The pair of left and right blockish inside pads 38*a* and 38*b* are symmetrical, as described above, and the pair of left and right attaching portions 90 are also symmetrical. Hence, the blockish inside pad 38*b* for the right cheek and the right attaching portion 90 to which it is to be attached will be described hereinafter in detail with reference to FIGS. 3 to 7 and FIGS. 12 to 14, and a detailed description on the blockish inside pad 38*a* for the left cheek and the left attaching portion 90 to which it is to be attached will be omitted as needed.

Figure 3:
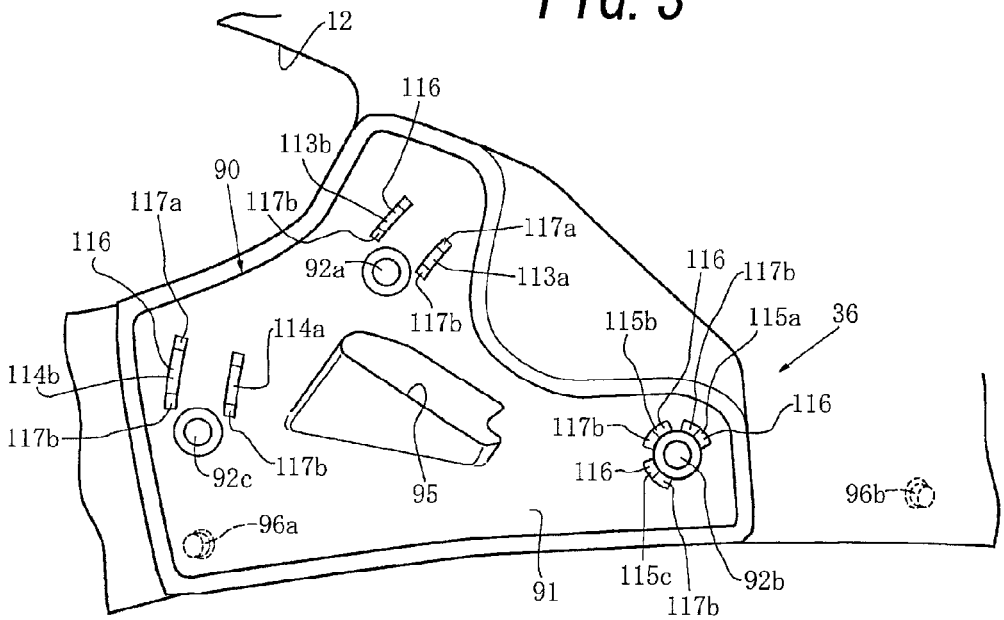
FIG. 3 is a front view of an attaching portion of an impact-on-the-chin-and-right-cheek absorbing liner to which the blockish inside pad for the right cheek shown in FIG. 2 is attached.

As shown in FIGS. 3 and 14, the female portions (that is, the female hooks) 92*a*, 92*b* and 92*c* of the round hooks 50*a* to 50*c* serving as the recess-projection fitting mechanisms are formed on the right support member 91 by attaching with rivets 93, integral molding with the support member 91 or the like so as to oppose the male hooks 56*a*, 56*b* and 56*c* of the corresponding one of the pair of blockish inside pads 38*a* and 38*b* for the left and right cheeks shown in FIG. 2. The female hooks 92*a* to 92*c*, together with the male hooks 56*a* to 56*c*, constitute the round hooks 50*a* to 50*c* serving as the recess-projection fitting mechanisms. The impact-on-the-chin-and-cheek absorbing liner 37 has recesses 94 corresponding to the female hooks 92*a*, 92*b*, 92*c* and the like, respectively. The main body portion of the impact-on-the-chin-and-cheek absorbing liner 37 may be partially covered in advance with a flexible sheet such as a porous nonwoven fabric or vinyl leather. The main body portion may have openings through which the chin straps 14 are to be inserted. The support member 91 may also have an opening 95 or a notch, at its center, to correspond to the opening in the corresponding main body portion. Furthermore, each of the main body portion of the impact-on-the-chin-and-cheek absorbing liner 37 and that of the impact-on-the-head absorbing liner 29 may be provided with engaging pins 96*a* and 96*b* which oppose the notches 82*a* and 82*b*, respectively, of the corresponding engaged member 42 and engage with them relatively.

As shown in FIGS. 3 and 14, the right support member 91 has narrow guiding longitudinal recesses 113*a*, 113*b*, 114*a*, 114*b* and 115*a* to 115*c* having shapes substantially corresponding to the guided longitudinal projections 72*a*, 72*b*, 73*a*, 73*b* and 74*a* to 74*c*, respectively, of the outer holding member 54 and arranged to substantially correspond to them. When the blockish inside pad 38*b* for the right cheek is attached to the support member 91, the guided longitudinal projections 72*a*, 72*b*, 73*a*, 73*b* and 74*a* to 74*c* relatively fit with the guiding longitudinal recesses 113*a*, 113*b*, 114*a*, 114*b* and 115*a* to 115*c*, respectively. Therefore, each of the guiding longitudinal recesses 113*a*, 113*b*, 114*a* and 114*b* has a substantially flat low-level surface 116 substantially corresponding to the high-level surface 75, and a pair of slant surfaces 117*a* and 117*b* respectively continuous to the two ends of the low-level surface 116 to be gradually high. Each of the guiding longitudinal recesses 115*a* to 115*c* has a substantially flat low-level surface 116 and a slant surface 117*b* continuous to one end of the low-level surface 116 to be gradually high. Hence, the guiding longitudinal recesses 113*a*, 113*b*, 114*a*, 114*b* and 115*a* to 115*c* preferably satisfy one, a plurality, or all of the numerical ranges corresponding to the numerical ranges described in items (a) to (e) in "2. Composition of Blockish Inside Pad for Cheek" described above. In this case, the guided longitudinal projections 72*a*, 72*b*, 73*a*, 73*b* and 74*a* to 74*c* described in the above items (a) to (e), the slant surfaces 76*b* serving as the recess-projection fitting disengaging slant surfaces and the high-level surfaces 75 correspond to the guiding longitudinal recesses 113*a*, 113*b*, 114*a*, 114*b* and 115*a* to 115*c*, the slant surfaces 117*b* serving as the recess-projection fitting disengaging slant surfaces and the low-level surfaces 116, respectively.

To attach the blockish inside pad 38*b* for the right cheek shown in FIG. 2 to the impact-on-the-chin-and-cheek absorbing liner 37 as shown in FIGS. 1 and 12, the male hooks 56*a* to 56*c* of the inside pad 38*b* may be recess-projection engaged with the female hooks 92*a* to 92*c*, respectively, of the impact absorbing liner 37. In this case, annular projections 97 formed of the distal end portions of the male hooks 56*a* to 56*c* elastically engage with annular projections 98 formed of the front end portions of the female hooks 92*a* to 92*c*, respectively. Also, the engaged member 42 of the inside pad 38*b* is inserted in advance between the outer cap shell 31 and the blockish inside pad 38*b* for the right cheek, and between the outer cap shell 31 and impact-on-the-head absorbing liner 29 from below. At this time, the inserting portion 85 of the inside pad 38*b* is also inserted between the outer cap shell 31 and impact-on-the-head absorbing liner 29 from below. Also, as shown in FIG. 2, the pad-pull member 101 attached to the engaged member 42 is also inserted, together with the engaged member 42, between the outer cap shell 31 and impact-on-the-head absorbing liner 29 from below, and its bend portion 105 substantially abuts against the lower end face of the pad main body 41 of the inside pad 38*b*. Therefore, the handle 103 of the pull member 101 is temporarily fixed to the head protecting cap portion 3, as indicated by the right pad-pull member 101 in FIG. 15. The engaging pins 96*a* and 96*b* of the impact absorbing liners 37 and 29 are relatively fitted with the notches 82*a* and 82*b*, respectively, of the engaged member 42 from above and recess-projection engage with them. Furthermore, the chin strap 14 inserted in the opening 95 of the support member 91 of the impact absorbing liner 37 is relatively inserted in the notch 43 of the inside pad 38*b*. When removing the inside pad 38*b* from the impact absorbing liners 37 and 29, operation opposite to that of the case of attaching described above may be performed, or detaching operation described in the following "5. Helmet Removing Operation" may be performed.

5. Helmet Removing Operation

In the state shown in FIG. 15 in which the helmet wearer 2 wears the full-face-type helmet 1 shown in FIGS. 1 to 14, a person (e.g., a person who takes care of the rider having a motor cycle accident; the helmet wearer 2 himself can also remove the helmet 1 in the same manner) other than the helmet wearer 2 can remove the helmet 1 from the head 11 of the helmet wearer 2 in the following steps (1) to (7).

(1) First, the person disengages the pair of right and left chin straps 14 from each other, as shown in FIG. 15.

(2) Second, assume that the bend portion 105 of each or one of the pair of right and left pull members 101 abuts against the lower end face of the pad main body 41 of the corresponding one of the inside pads 38*a* and 38*b* (see the right pull member 101 shown in FIG. 15). In this case, the person holds the bend portion 105 of at least one pull member 101 with the fingers of his hand 118 and pulls it outward to release the preliminarily attached pull member 101, and places his finger in the finger catch opening 100 of the handle 103 and pulls most of the pull member 101 outward, as indicated by the right pull member 101 in FIG. 15.

Figure 5:
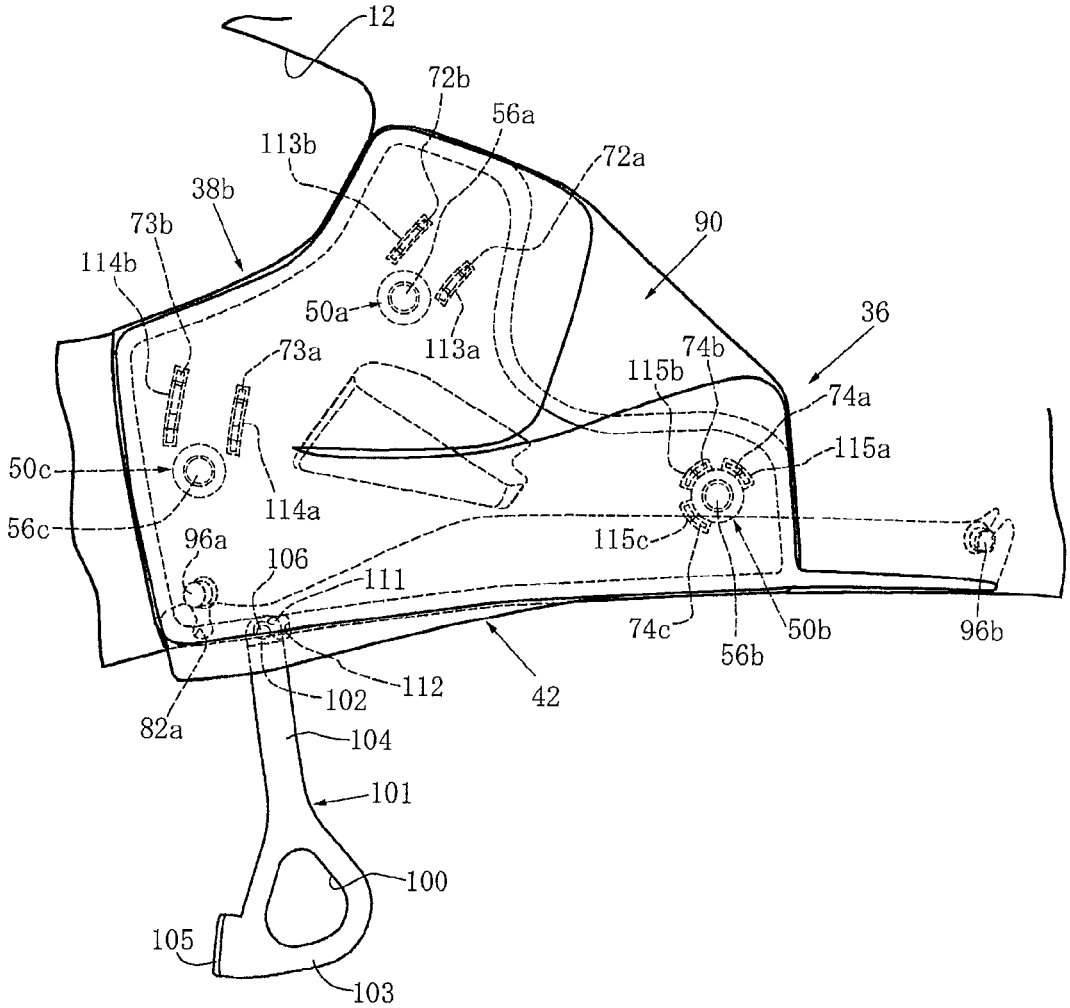
FIG. 5 is a front view, similar to FIG. 4, showing the blockish inside pad for the right cheek in the first state during the process of pulling out the blockish inside pad for the right cheek shown in FIG. 4 from the attaching portion shown in FIG. 3.

(3) The person then slightly pulls the pull members 101, which are pulled out in this manner, substantially downward (i.e., toward the front side in FIG. 15) from the helmet 1 with his hands 118. This slightly extracts the engaged members 42 of the inside pads 38*a* and 38*b* to substantially below the helmet 1 from between the outer cap shell 31 (more specifically, the lower rim member 32) and impact-on-the-chin-and-cheek absorbing liner 37, and between the lower rim member 32 and impact-on-the-head absorbing liner 29, as shown in FIG. 5. Accordingly, the engaging pins 96*a* respectively engaging with the notches 82*a* of the engaged members 42 relatively disengage from the notches 82*a*, respectively.

Figure 6:
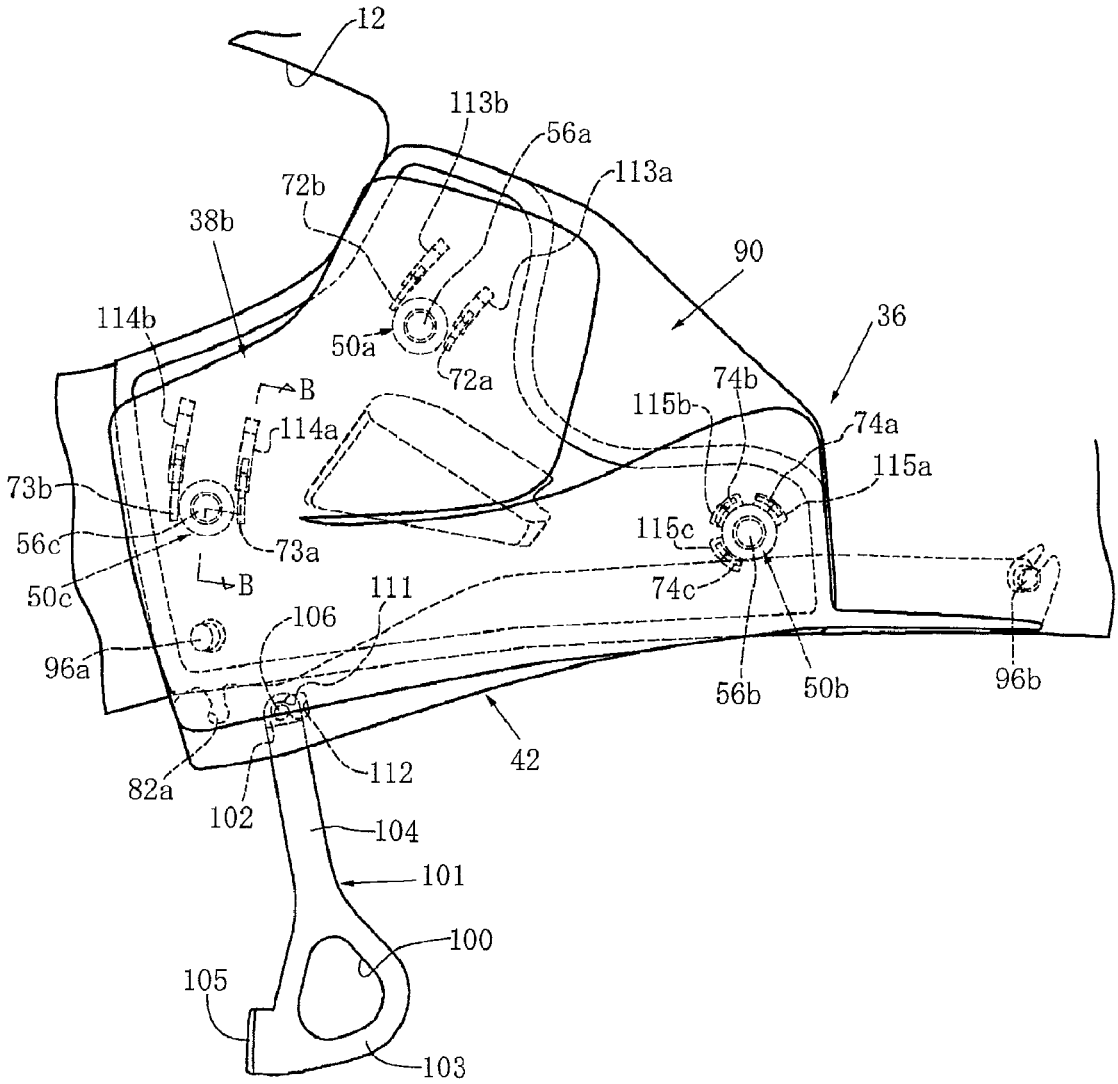
FIG. 6 is a front view, similar to FIG. 4, showing the blockish inside pad for the right cheek in the second state during the process of pulling out the blockish inside pad for the right cheek shown in FIG. 4 from the attaching portion shown in FIG. 3.

(4) The person continuously pulls the pull members 101 with his hands 118 substantially downward. As shown in FIG. 6, the blockish inside pads 38*a* and 38*b* for the cheeks are to slightly pivot forward counterclockwise in FIG. 6 about the round hooks 50*b* serving as the recess-projection fitting mechanisms as the fulcrums. These pivot torques press the slant surfaces 117*b* of the guiding longitudinal recesses 113*a*, 113*b*, 114*a* and 114*b* through the slant surfaces 76*b* of the guided longitudinal projections 72*a*, 72*b*, 73*a* and 73*b*, so that the slant surfaces 76*b* receive reaction forces from the slant surfaces 117*b*. Hence, the slant surfaces 76*b* (and accordingly the guided longitudinal projections 72*a*, 72*b*, 73*a* and 73*b*) move in directions to separate from the support members 91 by these reaction forces. Consequently, the male hooks 56*a* and 56*c* disengage from the female hooks 92*a* and 92*b*.

(5) The person continuously pulls the pull members 101 with his hands 118 substantially downward. The blockish inside pads 38*a* and 38*b* for the cheeks pivot further forward counterclockwise in FIG. 6 about the round hooks 50*b* as the fulcrums, and reach the state shown in FIG. 7. Therefore, as shown in FIG. 7, most portions (in other words, the front portions and intermediate portions) of the inside pads 38*a* and 38*b* are extracted outward from inside the outer cap shell 31.

(6) Where necessary, the person keeps pulling the pull members 101 continuously with his hands 118. Then, in the same manner as in the case described in the above item (4), the pivot torques of the inside pads 38*a* and 38*b* press the slant surfaces 117*b* of the guiding longitudinal recesses 115*a* to 115*c* through the slant surfaces 76*b* of the guided longitudinal projections 74*a* to 74*c*, so that the slant surfaces 76*b* receive reaction forces from the slant surfaces 117*b*. Hence, the slant surfaces 76*b* (and accordingly the guided longitudinal projections 74*a* to 74*c*) move in directions to separate from the support members 91 by these reaction forces. Consequently, each male hook 56*b* disengages from the corresponding female hook 92*b*. Where necessary, the person extracts the inside pads 38*a* and 38*b* from inside the outer cap shell 31 completely. In this case, the engaging pins 96*b* engaging with the notches 82*b* of the engaged members 42 relatively disengage from the notches 82*b*.

(7) The person holds the head protecting cap portion 3 with his hands 118 and separates it from the head 11 of the helmet wearer 2. In this case, at least one of the blockish inside pads 38*a* and 38*b* for the cheeks is no longer in the head protecting cap portion 3 entirely or partly. Hence, the person can easily remove the head protecting cap portion 3 from the head 11 of the helmet wearer 2.

Having described a specific preferred embodiment of the present invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment, the blockish inside pad which is to be extracted at least partly by the pad-pull members 101 from inside the head protecting cap portion 3 includes the blockish inside pads 38*a* and 38*b* for the right and left cheeks. Alternatively, the blockish inside pad to be extracted may include an additional blockish inside pad for the forehead, or another existing or additional blockish inside pad.

In the above embodiment, the bag-like member 45 of the pad main body 41 of each of the blockish inside pads 38*a* and 38*b* for the cheeks includes the pair of inner and outer holding members 53 and 54. However, the bag-like member 45 need not include the pair of holding members 53 and 54 but may include only one holding member (more particularly, the inner holding member 53), and the entire bag-like member 45 may be formed of a flexible sheet member, as has been well known. In the latter case, one or a plurality of hook attaching plates (not shown) to attach the male hooks 56*a* to 56*c* can be attached to the bag-like member 45.

In the above embodiment, the three male hooks 56*a* to 56*c* are disposed on each of the blockish inside pads 38*a* and 38*b* for the cheeks. Alternatively, a different number of male hooks 56*a* to 56*c* (accordingly a different number of female hooks 92*a* to 92*c* and a different number of round hooks 50*a* to 50*c* serving as the recess-projection fitting mechanisms), e.g., two, or four or more, can be disposed on each of the blockish inside pads 38*a* and 38*b*, and the like.

In the above embodiment, the pad-pull members 101 disengage not all (more specifically, three) of the male hooks 56*a* to 56*c* disposed on each of the blockish inside pads 38*a* and 38*b* for the cheeks, but some male hooks (more particularly, the two male hooks 56*a* and 56*c*) from the female hooks 92*a* and 92*b* at the initial time point (in other words, in the step described in the above item (4)). However, the male hooks 56*a* to 56*c* to be disengaged from the female hooks 92*a* to 92*c* by the pad-pull members 101 at the initial time point may be all of the male hooks 56*a* to 56*c*.

In the above embodiment, the male hooks 56*a* to 56*c* of the round hooks 50*a* to 50*c* are attached and fixed to each of the inside pads 38*a* and 38*b*. Inversely, regarding one, a plurality, or all of the round hooks 50*a* to 50*c*, the mutual positional relationship between the male hooks 56*a* to 56*c* and female hooks 92*a* to 92*c* may be reversed, and the female hooks 92*a* to 92*c* may be attached and fixed to each of the inside pads 38*a* and 38*b*.

In the above embodiment, the outer holding member 54 has the potbelly holes 57*a* to 57*c* as the engaging holes to engage with the male hooks 56*a* to 56*c*. However, the engaging holes 57*a* to 57*c* need not be potbelly holes, but may be notched engaging holes.

In the above embodiment, each of the round hooks 50*a* to 50*c* is provided with two or three recess-projection fitting disengaging slant surfaces 76*b* (in other words, recess-projection fitting disengaging slant surfaces 117*b*). Alternatively, each of the round hooks 50*a* to 50*c* may be provided with one, four, or more recess-projection fitting disengaging slant surfaces 76*b* (in other words, recess-projection fitting disengaging slant surfaces 117*b*).

In the above embodiment, each of the guiding longitudinal recesses 113*a*, 113*b*, 114*a*, 114*b* and 115*a* to 115*c* is provided with one or a pair of slant surfaces 117*a* and 117*b*. Alternatively, each of the longitudinal recesses 113*a*, 113*b*, 114*a*, 114*b* and 115*a* to 115*c* may entirely form a low-level surface 116. In this case, the end of each low-level surface 116 abuts against the corresponding recess-projection fitting disengaging slant surface 76*b*, so that it serves as a recess-projection fitting disengaging abutting portion.

In the above embodiment, each of the guided longitudinal projections 72*a*, 72*b*, 73*a*, 73*b* and 74*a* to 74*c* is provided with one or a pair of slant surfaces 76*a* and 76*b*. Alternatively, each of the guided longitudinal projections 72*a*, 72*b*, 73*a*, 73*b* and 74*a* to 74*c* may entirely form a high-level surface 75. In this case, the end of each high-level surface 75 abuts against the corresponding recess-projection fitting disengaging slant surface 117*b*, so that it serves as a recess-projection fitting disengaging abutting portion.

In the above embodiment, the pad-pull members 101 to pull out the inside pads 38*a* and 38*b* from inside the head protecting cap portion 3 at least partly are respectively disposed on the inside pads 38*a* and 38*b*. However, the pad-pull members 101 can be omitted when appropriate. In this case, the person may pull out at least one of the inside pads 38*a* and 38*b* substantially downward by holding its lower end with his hand.

In the above embodiment, each bag-like member 45 stores only one cushion member 44. Alternatively, two or more cushion members 44 may be stacked in a plurality of layers and stored in each bag-like member 45.

In the above embodiment, the engaging projections (in other words, male hooks) 56*a* to 56*c* of the recess-projection engaging mechanisms that detachably engage the plurality of holding members 53 and 54 with each other by recess-projection engagement also serve as the fitting projections of the recess-projection fitting mechanisms 50*a* to 30*c* that detachably recess-projection fit the inside pads 38*a* and 38*b* with the head protecting cap portion 3 when incorporating the inside pads 38*a* and 38*b* in the head protecting cap portion 3. Alternatively, the latter fitting projections may be separately provided on the outer holding member 54 or the like. The both of the projection-recess engaging mechanisms and the recess projection fitting mechanisms 50*a* to 50*c* are not always necessary. In this case, the former projection-recess engaging mechanisms may be replaced by other fitting mechanisms such as tapes.

In the above embodiment, when the two holding members 53 and 54 are connected to each other by recess-projection engagement, they overlie on each other such that one holding member 53 comes inside and the other holding member 54 comes outside.

Alternatively, the two holding members 53 and 54 may overlie on each other such that one holding member 53 comes partly inside and partly outside, and the other holding member 54 comes partly outside and partly inside.

In the above embodiment, each of the holding members 53 and 54 forms a substantially yoked shape, and the holding members 53 and 54 respectively have the plurality of openings 55 and 57 to improve the elasticity and reduce the weight. However, each of the holding members 53 and 54 need not always form a yoked shape, and the openings 55 and 57 can be omitted when appropriate.

In the above embodiment, the present invention is applied to the full-face-type helmet 1. However, the present invention can also be applied to a helmet of another type, e.g., a jet type, semi-jet type or the like.

The invention claimed is:

1. A helmet comprising:

a head protecting cap;

a pad inside the cap;

a male hook and a female hook, one of which is located on the pad and the other of which is located on the cap, with the male hook releasably interlocked with the female hook, and with the male hook being releasable from the female hook in a first direction; and a pair of slant surfaces, one of which is located on the pad as a member separated from the hook on the pad and the other of which is located on the cap as a member separated from the hook on the cap, arranged to slide against each other upon movement of the pad relative to the cap in a second direction transverse to the first direction, and to push the pad apart from the cap in the first direction to release the male hook from the female hook upon sliding against each other.

2. A helmet as defined in claim 1 wherein the slant surfaces are inclined at a slant angle measured as an acute angle from a line extending in the second direction.

3. A helmet as defined in claim 2 wherein the slant angle is within the range of 11-40 degrees.

4. A helmet as defined in claim 2 wherein the slant angle is within the range of 12-28 degrees.

5. A helmet as defined in claim 2 wherein the slant angle is about 15 degrees.

6. A helmet as defined in claim 2 wherein the slant angle is about 30 degrees.

7. A helmet as defined in claim 1 further comprising an elongated handle supported on the pad for movement pivotally from a storage position extending lengthwise within the cap along a lower edge of the cap to an actuated position extending longitudinally outward from within the cap to the exterior of the cap in the second direction.

8. A helmet comprising:

a head protecting cap;

a pad inside the cap;

a pivot supporting the pad for movement relative to the cap pivotally about an axis;

a male hook and a female hook, one of which is located on the pad and the other of which is located on the cap, with the male hook releasably interlocked with the female hook, and with the male hook being releasable from the female hook in a release direction parallel to the axis; and a pair of slant surfaces, one of which is located on the pad as a member separated from the hook on the pad and the other of which is located on the cap as a member separated from the hook on the cap, with the slant surfaces arranged to slide against each other upon movement of the pad relative to the cap pivotally about the axis, and to push the pad apart from the cap in the release direction to release the male hook from the female hook upon sliding against each other.

9. A helmet as defined in claim 8 wherein the male hook includes the pivot.

10. A helmet as defined in claim 9 wherein the male hook, the female hook, and the slant surfaces are parts of a release mechanism that is spaced radially from the pivot.

11. A helmet as defined in claim 10 wherein the release mechanism includes a keyhole slot in which the male hook is received, and the male hook is moveable in the keyhole slot along an arc that is centered on the axis.

12. A helmet as defined in claim 8 wherein the male hook, the female hook, and the slant surfaces are parts of a release mechanism that is spaced radially from the pivot, and the release mechanism is one of a plurality of release mechanisms spaced radially from the pivot, each of which includes a male hook, a female hook, and a pair of slant surfaces.

13. A helmet as defined in claim 12 wherein the plurality of release mechanisms spaced radially from the pivot include a release mechanism in which the respective slant surfaces are inclined at a first slant angle, and further include a release mechanism in which the respective slant surfaces are inclined at a second slant angle that is less than the first slant angle.

14. A helmet as defined in claim 13 wherein the first slant angle is about 30 degrees and the second slant angle is about 15 degrees.

15. A helmet as defined in claim 13 wherein the first and second slant angles are within the range of 11-40 degrees.

16. A helmet as defined in claim 13 wherein the first and second slant angles are within the range of 12-38 degrees.

17. A helmet as defined in claim 8 wherein the male hook, the female hook, and the slant surfaces are parts of a first release mechanism that is spaced radially from the pivot, the helmet further comprises an additional release mechanism that includes a male hook, a female hook, and a pair of slant surfaces, and the male hook in the additional release mechanism includes the pivot.

18. A helmet as defined in claim 17 wherein the slant surfaces in the first release mechanism and the additional release mechanism are arranged to release the male hooks from the female hooks sequentially.

19. A helmet as defined in claim 18 wherein the slant surfaces are arranged to first release the male hook from the female hook in the first release mechanism.

* * * * *